US007238458B2

(12) United States Patent
Kuramoto et al.

(10) Patent No.: US 7,238,458 B2
(45) Date of Patent: Jul. 3, 2007

(54) PHOTO CONDUCTOR, IMAGE FORMING APPARATUS, AND METHOD FOR PRODUCING PHOTO CONDUCTOR

(75) Inventors: Yukimasa Kuramoto, Hyougo (JP); Sotoshi Takimoto, Tochigi (JP); Ryuichi Shingae, Tochigi (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 357 days.

(21) Appl. No.: 10/995,505

(22) Filed: Nov. 24, 2004

(65) Prior Publication Data

US 2005/0175915 A1 Aug. 11, 2005

(30) Foreign Application Priority Data

Jan. 7, 2004 (JP) ..... P2004-001695
Mar. 29, 2004 (JP) ..... P2004-096923

(51) Int. Cl.
*G03G 15/04* (2006.01)

(52) U.S. Cl. ..... 430/66; 430/132; 399/159

(58) Field of Classification Search ..... 430/66, 430/132; 399/159
See application file for complete search history.

(56) References Cited

U.S. PATENT DOCUMENTS 4,755,444 A * 7/1988 Karakida et al. ..... 430/66

FOREIGN PATENT DOCUMENTS

JP 2590971 12/1996

OTHER PUBLICATIONS

English Language Abstract of Publication of Application No. 62294477 which became Japanese Patent No. 2590971.

* cited by examiner

*Primary Examiner*—Mark A. Chapman
(74) *Attorney, Agent, or Firm*—Greenblum & Bernstein, P.L.C.

(57) ABSTRACT

A photo conductor has a protective surface layer whereon at least a carrier generation layer and a carrier transport layer are provided onto a conductive base. The protective surface layer includes a first protective surface layer using a hydrocarbon gas-based amorphous carbon with an ion implantation layer, and a second protective surface layer using a hydrocarbon gas-based amorphous carbon without an ion implantation layer.

60 Claims, 27 Drawing Sheets

Fig. 4

| | First protective surface layer | Second protective surface layer |
|---|---|---|
| Layer shape | Ion implantation layer | Deposition layer |
| CVD gas | Hydrocarbon gas (such as methane) | Hydrogen diluted hydrocarbon gas (such as methane) |
| Gas pressure (relative value) | 1 – 2 | 2 – 3 |
| Substrate application voltage | DC, -500 to -1000 V | DC, -100 to -500 V |
| Electrode application voltage | High-frequency voltage | High-frequency voltage |
| Membrane thickness (:m) | 0.01 – 0.1 | 0.1 – 2 |

Fig. 5

| | Evaluation item | | Adhesiveness | Resolution |
|---|---|---|---|---|
| | Evaluation method | | After 1,000 prints | Initial print |
| | Deposition layer | | | |
| Single layer CVD | Methane gas | | × | × |
| | Hydrogen diluted methane gas | | × | ○ |
| | Argon diluted methane gas | | × | × |
| | First layer (ion implantation layer) | Second layer (deposition layer) | | |
| Two layer CVD | Methane gas | Methane gas | ○ | △ |
| | Methane gas | Hydrogen diluted methane gas | ○ | ○ |
| | Methane gas | Argon diluted methane gas | ○ | × |

○---good
△---fair
×---bad

Fig. 6

Ion energy / gas pressure

| First layer | | |
|---|---|---|
| Evaluation item | Adhesiveness | Ion energy |
| Evaluation method | After 1,000 prints | |
| Gas pressure (relative value) | | |
| 1 | ○ | High |
| 1.5 | ○ | High |
| 2 | △ | Somewhat high |
| 2.5 | × | Low |
| 3 | × | Low |
| Second layer | | |
| Evaluation item | Resolution | Ion energy |
| Evaluation method | Initial print | |
| Gas pressure (relative value) | | |
| 1 | × | High |
| 1.5 | × | High |
| 2 | △ | Somewhat high |
| 2.5 | ○ | Low |
| 3 | ○ | Low |

○---good
△---fair
×---bad

Fig. 7

Ion energy / bias voltage (DC)

| First layer | | |
|---|---|---|
| Evaluation item | Adhesiveness | Ion energy |
| Evaluation method | After 1,000 prints | |
| Bias voltage (V) | | |
| -100 | × | Low |
| -300 | × | Low |
| -500 | △ | Somewhat high |
| -1000 | ○ | High |
| Second layer | | |
| Evaluation item | Resolution | Ion energy |
| Evaluation method | Initial print | |
| Bias voltage (V) | | |
| -100 | ○ | Low |
| -300 | ○ | Low |
| -500 | △ | Somewhat high |
| -1000 | × | High |

○---good
△---fair
×---bad

Fig. 9

| | First protective surface layer | Second protective surface layer |
|---|---|---|
| Layer shape | Ion implantation layer | Deposition layer |
| CVD gas | Hydrocarbon gas (such as methane) | Hydrogen diluted hydrocarbon gas (such as methane) |
| Gas pressure (relative value) | 1 – 2 | 2 – 3 |
| Substrate application voltage | Pulse, -5 to -10 kV<br>High-frequency voltage pulse | Pulse, -500 to -1,000 V,<br>High-frequency voltage pulse |
| High-frequency pulse width<br>Bias pulse width<br>Delay time | 10 – 20 :sec<br>3 – 10 :sec<br>80 – 150 :sec | 50 – 200 :sec<br>20 – 50 :sec<br>10 – 50 :sec |
| Membrane thickness (:m) | 0.01 – 0.1 | 0.1 – 2 |

Fig. 10

Ion energy / bias voltage (pulse)

| First layer | | |
|---|---|---|
| Evaluation item | Adhesiveness | Ion energy |
| Evaluation method | After 1,000 prints | |
| Bias voltage (kV) | | |
| -0.5 | × | Low |
| -1 | × | Low |
| -2 | △ | Somewhat high |
| -5 | ○ | High |
| -10 | ○ | High |
| Second layer | | |
| Evaluation item | Resolution | Ion energy |
| Evaluation method | Initial print | |
| Bias voltage (kV) | | |
| -0.5 | ○ | Low |
| -1 | ○ | Low |
| -2 | △ | Somewhat high |
| -5 | × | High |
| -10 | × | High |

○---good
△---fair
×---bad

Fig. 11

Ion energy / bias pulse width

| First layer | | |
|---|---|---|
| Evaluation item | Adhesiveness | Ion energy |
| Evaluation method | After 1,000 prints | |
| Bias pulse width (μs) | | |
| 5 | ○ | High |
| 10 | △ | Somewhat high |
| 20 | × | Low |
| 30 | × | Low |
| 50 | × | Low |
| Second layer | | |
| Evaluation item | Resolution | Ion energy |
| Evaluation method | Initial print | |
| Bias pulse width (μs) | | |
| 5 | × | High |
| 10 | △ | Somewhat high |
| 20 | ○ | Low |
| 30 | ○ | Low |
| 50 | ○ | Low |

○---good
△---fair
×---bad

Fig. 12

Ion energy / high-frequency pulse width

| First layer | | |
|---|---|---|
| Evaluation item | Adhesiveness | Ion energy |
| Evaluation method | After 1,000 prints | |
| High-frequency pulse width (μs) | | |
| 10 | ○ | High |
| 20 | ○ | High |
| 50 | △ | Somewhat high |
| 100 | × | Low |
| 200 | × | Low |
| Second layer | | |
| Evaluation item | Resolution | Ion energy |
| Evaluation method | Initial print | |
| High-frequency pulse width (μs) | | |
| 10 | × | High |
| 20 | × | High |
| 50 | △ | Somewhat high |
| 100 | ○ | Low |
| 200 | ○ | Low |

○---good
△---fair
×---bad

Fig. 13

Electron temperature / delay time

| First layer | | |
|---|---|---|
| Evaluation item | Adhesiveness | Ion energy |
| Evaluation method | After 1,000 prints | |
| Delay time (μs) | | |
| 0 | ○ | High |
| 5 | △ | Somewhat high |
| 15 | × | Low |
| 30 | × | Low |
| 50 | × | Low |
| 75 | △ | Somewhat high |
| 100 | ○ | High |
| Second layer | | |
| Evaluation item | Resolution | Ion energy |
| Evaluation method | Initial print | |
| Delay time (μs) | | |
| 0 | × | High |
| 5 | △ | Somewhat high |
| 15 | ○ | Low |
| 30 | ○ | Low |
| 50 | ○ | Low |
| 75 | △ | Somewhat high |
| 100 | × | High |

○---good
△---fair
×---bad

Fig. 19

| | First protective surface layer | Second protective surface layer | Third protective surface layer |
|---|---|---|---|
| Layer shape | Ion implantation layer | Deposition layer | High-resistance deposition layer (insulation layer) |
| CVD gas | Hydrocarbon gas (such as methane) | Hydrogen diluted hydrocarbon gas (such as methane) | Hydrogen diluted hydrocarbon gas (such as methane) |
| Gas pressure (relative value) | 1 – 2 | 1 – 2 | 2 – 3 |
| Substrate application voltage | DC, -500 to -1000V | DC, -200 to -500V | DC, 0 to -100V |
| Electrode applied voltage | High-frequency voltage | High-frequency voltage | High-frequency voltage |
| Membrane thickness (:m) | 0.01 – 0.1 | 0.1 – 2 | 0.01 – 0.1 |

Fig. 20

Ion energy / gas pressure

| First, second layer | | |
|---|---|---|
| Evaluation item | Adhesiveness | Ion energy |
| Evaluation method | After 1,000 prints | |
| Gas pressure (relative value) | | |
| 1 | ○ | High |
| 1.5 | ○ | High |
| 2 | △ | Somewhat high |
| 2.5 | × | Low |
| 3 | × | Low |
| Third layer | | |
| Evaluation item | Resolution | Ion energy |
| Evaluation method | Initial print | |
| Gas pressure (relative value) | | |
| 1 | × | High |
| 1.5 | × | High |
| 2 | △ | Somewhat high |
| 2.5 | ○ | Low |
| 3 | ○ | Low |

○---good
△---fair
×---bad

Fig. 21

Ion energy / bias voltage (DC)

| First, second layer | | |
|---|---|---|
| Evaluation item | Adhesiveness | Ion energy |
| Evaluation method | After 1,000 prints | |
| Bias voltage (V) | | |
| -100 | × | Low |
| -300 | × | Low |
| -500 | △ | Somewhat high |
| -1000 | ○ | High |
| Third layer | | |
| Evaluation item | Resolution | Ion energy |
| Evaluation method | Initial print | |
| Bias voltage (V) | | |
| -100 | ○ | Low |
| -300 | ○ | Low |
| -500 | △ | Somewhat high |
| -1000 | × | High |

○---good
△---fair
×---bad

Fig. 22

| | First protective surface layer | Second protective surface layer | Third protective surface layer |
|---|---|---|---|
| Layer shape | Ion implantation layer | Deposition layer | High-resistance deposition layer (insulation layer) |
| CVD gas | Hydrocarbon gas (such as methane) | Hydrogen diluted hydrocarbon gas (such as methane) | Hydrogen diluted hydrocarbon gas (such as methane) |
| Gas pressure (relative value) | 1 – 2 | 1 – 2 | 2 – 3 |
| Substrate application voltage | Pulse, -5 to -10 kV<br>High-frequency voltage pulse | Pulse, -1,000 to -2,000 V<br>High-frequency voltage pulse | Pulse, -100 to -500 V<br>High-frequency voltage pulse |
| High-frequency pulse width<br>Bias pulse width<br>Delay time | 10 – 20 :sec<br>3 – 10 :sec<br>80 – 150 :sec | 10 – 20 :sec<br>3 – 10 :sec<br>80 – 150 :sec | 50 – 200 :sec<br>20 – 50 :sec<br>10 – 50 :sec |
| Membrane thickness (:m) | 0.01 – 0.1 | 0.1 – 2 | 0.01 – 0.1 |

Fig. 23

Ion energy / bias voltage (pulse)

| First, second layer | | |
|---|---|---|
| Evaluation item | Adhesiveness | Ion energy |
| Evaluation method | After 1,000 prints | |
| Bias voltage (kV) | | |
| -0.5 | × | Low |
| -1 | × | Low |
| -2 | △ | Somewhat high |
| -5 | ○ | High |
| -10 | ○ | High |
| Third layer | | |
| Evaluation item | Resolution | Ion energy |
| Evaluation method | Initial print | |
| Bias voltage (kV) | | |
| -0.5 | ○ | Low |
| -1 | ○ | Low |
| -2 | △ | Somewhat high |
| -5 | × | High |
| -10 | × | High |

○---good
△---fair
×---bad

Fig. 24

Ion energy / bias pulse width

| First, second layer | | |
|---|---|---|
| Evaluation item | Adhesiveness | Ion energy |
| Evaluation method | After 1,000 prints | |
| Bias pulse width (μs) | | |
| 5 | ○ | High |
| 10 | △ | Somewhat high |
| 20 | × | Low |
| 30 | × | Low |
| 50 | × | Low |
| Third layer | | |
| Evaluation item | Resolution | Ion energy |
| Evaluation method | Initial print | |
| Bias pulse width (μs) | | |
| 5 | × | High |
| 10 | △ | Somewhat high |
| 20 | ○ | Low |
| 30 | ○ | Low |
| 50 | ○ | Low |

○---good
△---fair
×---bad

Fig. 25

Ion energy / high-frequency pulse width

| First, second layer | | |
|---|---|---|
| Evaluation item | Adhesiveness | Ion energy |
| Evaluation method | After 1,000 prints | |
| High-frequency pulse width (μs) | | |
| 10 | ○ | High |
| 20 | ○ | High |
| 50 | △ | Somewhat high |
| 100 | × | Low |
| 200 | × | Low |
| Third layer | | |
| Evaluation item | Resolution | Ion energy |
| Evaluation method | Initial print | |
| High-frequency pulse width (μs) | | |
| 10 | × | High |
| 20 | × | High |
| 50 | △ | Somewhat high |
| 100 | ○ | Low |
| 200 | ○ | Low |

○---good
△---fair
×---bad

Fig. 26

Electron temperature / delay time

| First, second layer | | |
|---|---|---|
| Evaluation item | Adhesiveness | Ion energy |
| Evaluation method | After 1,000 prints | |
| Delay time (μs) | | |
| 0 | ○ | High |
| 5 | △ | Somewhat high |
| 15 | × | Low |
| 30 | × | Low |
| 50 | × | Low |
| 75 | △ | Somewhat high |
| 100 | ○ | High |
| Third layer | | |
| Evaluation item | Resolution | Ion energy |
| Evaluation method | Initial print | |
| Delay time (μs) | | |
| 0 | × | High |
| 5 | △ | Somewhat high |
| 15 | ○ | Low |
| 30 | ○ | Low |
| 50 | ○ | Low |
| 75 | △ | Somewhat high |
| 100 | × | High |

○---good
△---fair
×---bad

Fig. 27

| | First protective surface layer | Second protective surface layer | Third protective surface layer | |
|---|---|---|---|---|
| Layer shape | Ion implantation layer | Deposition layer | Insulation layer | |
| CVD gas, processing | Hydrocarbon gas (such as methane) | Hydrogen diluted hydrocarbon gas (such as methane) | Oxygen gas | Heat treatment within air |
| Substrate application voltage | DC, -500 to -1,000 V | DC, -100 to -500 V | DC, 0 to -100 V | |
| Electrode application voltage | High-frequency voltage | High-frequency voltage | High-frequency voltage | |
| Membrane thickness (:m) | 0.01 – 0.1 | 0.1 – 2 | 0.01 – 0.1 | |

○---good
△---fair
×---bad

Fig. 28

Heat treatment, oxygen plasma

| | Evaluation item | External appearance | Resolution |
|---|---|---|---|
| | Evaluation method | Initial | After 500 prints |
| Heat treatment | None | ○ | – |
| | 50 °C, 120 minutes | ○ | △ |
| | 70 °C, 30 minutes | ○ | △ |
| | 80 °C, 30 minutes | ○ | ○ |
| | 90 °C, 30 minutes | ○ | ◎ |
| | 100 °C, 30 minutes | Small cracks occurred | ○ |
| Oxygen plasma process | 5 minutes | ○ | ○ |

◎---very good
○---good
△---fair
×---bad

Fig. 29

| | First protective surface layer | Second protective surface layer | Third protective surface layer | |
|---|---|---|---|---|
| Layer shape | Ion implantation layer | Deposition layer | Insulation layer | |
| CVD gas, processing | Hydrocarbon gas (such as methane) | Hydrogen diluted hydrocarbon gas (such as methane) | Oxygen gas | Heat treatment within air |
| Substrate application voltage | Pulse, -5 to –10 kV high-frequency voltage pulse | Pulse, -500 to -1,000 V high-frequency voltage pulse | Pulse, -500 to -1,000V high-frequency voltage pulse | |
| Membrane thickness (:m) | 0.01 – 0.1 | 0.1 – 2 | 0.01 – 0.1 | |

PHOTO CONDUCTOR, IMAGE FORMING APPARATUS, AND METHOD FOR PRODUCING PHOTO CONDUCTOR

BACKGROUND OF THE INVENTION

1. Field of the Invention

The present invention relates to a photo conductor that has a protective surface layer, the photo conductor being utilized in image forming apparatus that uses the photo conductor, and a method for producing photo conductor that has the protective surface layer.

2. Description of Related Art

Conventionally, the characteristics of photo conductor (in particular, sensitivity and residual potential) with excellent durability and which sufficiently satisfy functions as a photo conductor have existed as organic photo conductor that has a protective surface layer. This is an organic photo conductor provided with a plasma polymerized membrane on a protective surface layer.

For example, a technique is known to form on and over a resin layer a composition of a protective surface layer of an organic photo conductor that has an organic light conductive layer into a two layer composition of a very protective surface layer having an amorphous hydrocarbon membrane (a -C membrane: amorphous carbon) created by a plasma polymerization method to achieve a product with photo conductor properties that is especially sensitive without losing any residual potential and also has excellent durability (for example, Related Art 1).

[Related Art 1] Japanese Patent Publication No. 2,590,971

A conventional organic photo conductor provided with a protective surface layer having amorphous carbon has problems such as poor adhesion between the carrier transport layer that has the protective surface layer and organic resin, the protective surface layer being scraped due to scratches which occur when printing if the number of prints increases thereby reducing the lifespan of the organic photo conductor itself.

Furthermore, an organic photo conductor provided with a protective surface layer having amorphous carbon also has a problem of the decreased electrical resistance of a protective surface layer having deposition layers of amorphous carbon created by plasma CVD (chemical vapor deposition) of hydrocarbon gas diluted by argon gas or hydrocarbon gas only. Therefore, the image resolution becomes worsened.

Even further, an organic photo conductor provided with a protective surface layer having amorphous carbon also has a problem in which if the number of prints increases, the surface electrical resistance of foreign material adhering to the protective surface layer will decrease thereby worsening the image resolution after the image forming apparatus has not been used for a long period of time or during operation in high temperature/high humidity.

SUMMARY OF THE INVENTION

The present invention takes these problems into consideration and has an objective of providing a photo conductor that has a protective surface layer that can improve the density between the protective surface layer and the substrate layer, and lengthen the lifespan of the organic photo conductor. Another purpose of the present invention is to provide an image forming apparatus that uses this photo conductor and a manufacturing method of a photo conductor that has a protective surface layer.

The present invention is a photo conductor that has a protective surface layer whereon at least a carrier generation layer and a carrier transport layer are provided onto a conductive base and has a two layer construction on the protective surface layer comprising a first protective surface layer formed using a hydrocarbon gas-based amorphous carbon with ion implantation layer, and a second protective surface layer formed using a hydrocarbon gas-based amorphous carbon without an ion implantation layer.

Moreover, the present invention is a photo conductor that has a protective surface layer whereon at least a carrier generation layer and a carrier transport layer are provided onto a conductive base and the protective surface layer has a three layer construction comprising a first protective surface layer formed using a hydrocarbon gas-based amorphous carbon with an ion implantation layer, a second protective surface layer formed using a hydrocarbon gas-based amorphous carbon, and a third protective surface layer formed using an amorphous carbon and comprising an insulation layer set with an electrical resistance higher than the second protective surface layer.

BRIEF DESCRIPTION OF THE DRAWINGS

The present invention is further described in the detailed description which follows, with reference to the noted plurality of drawings by way of non-limiting examples of exemplary embodiments of the present invention, in which like reference numerals represent similar parts throughout the several views of the drawings, and wherein:

FIG. 4 shows an example of CVD gas and applied voltage utilized when forming a first protective surface layer and a second protective surface layer of the photo conductor related to the first embodiment;

FIG. 5 shows an example of results obtained when the photo conductor that has the protective surface layer related to the first embodiment is applied to an image forming apparatus;

FIG. 6 shows an example of results obtained when the photo conductor that has the protective surface layer related to the first embodiment is applied to an image forming apparatus;

FIG. 7 shows an example of results obtained when the photo conductor that has the protective surface layer related to the first embodiment is applied to an image forming apparatus;

FIG. 9 shows an example of CVD gas and applied voltage utilized when forming a first protective surface layer and a second protective surface layer of the photo conductor related to the second embodiment;

FIG. 10 shows an example of results obtained when the photo conductor that has the protective surface layer related to the second embodiment is applied to an image forming apparatus;

FIG. 11 shows an example of results obtained when the photo conductor that has the protective surface layer related to the second embodiment is applied to an image forming apparatus;

FIG. 12 shows an example of results obtained when the photo conductor that has the protective surface layer related to the second embodiment is applied to an image forming apparatus;

FIG. 13 shows an example of results obtained when the photo conductor that has the protective surface layer related to the second embodiment is applied to an image forming apparatus;

FIG. 19 shows an example of CVD gas and applied voltage utilized when forming a first protective surface layer, a second protective surface layer, and a third protective surface layer of the photo conductor related to the third embodiment;

FIG. 20 shows an example of results obtained when the photo conductor that has the protective surface layer related to the third embodiment is applied to an image forming apparatus;

FIG. 21 shows an example of results obtained when the photo conductor that has the protective surface layer related to the third embodiment is applied to an image forming apparatus;

FIG. 22 shows an example of CVD gas and applied voltage utilized when forming a first protective surface layer, a second protective surface layer, and a third protective surface layer of the photo conductor related to the fourth embodiment of the present invention;

FIG. 23 shows an example of results obtained when the photo conductor that has the protective surface layer related to the fourth embodiment is applied to an image forming apparatus;

FIG. 24 shows an example of results obtained when the photo conductor that has the protective surface layer related to the fourth embodiment is applied to an image forming apparatus;

FIG. 25 shows an example of results obtained when the photo conductor that has the protective surface layer related to the fourth embodiment is applied to an image forming apparatus;

FIG. 26 shows an example of results obtained when the photo conductor that has the protective surface layer related to the fourth embodiment is applied to an image forming apparatus;

FIG. 27 shows an example of CVD gas and applied voltage utilized when forming a first protective surface layer, a second protective surface layer, and a third protective surface layer of the photo conductor related to the fifth embodiment of the present invention;

FIG. 28 shows an example of results obtained when the photo conductor that has the protective surface layer related to the fifth embodiment is applied to an image forming apparatus;

FIG. 29 shows an example of CVD gas and applied voltage utilized when forming a first protective surface layer, a second protective surface layer, and a third protective surface layer of the photo conductor related to the sixth embodiment of the present invention.

DETAILED DESCRIPTION OF PREFERRED EMBODIMENTS

The embodiments of the present invention are explained in the following, in reference to the above-described drawings.

First Embodiment

Figure 1:
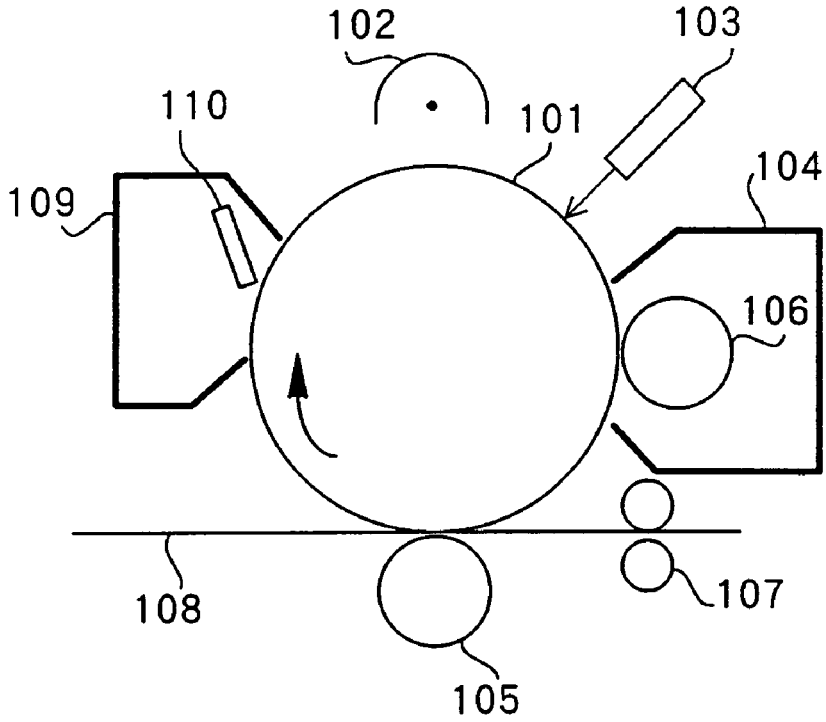
FIG. 1 shows the composition of the periphery of the image forming unit in an image forming apparatus wherein a photo conductor that has the protective surface layer related to the first embodiment of the present invention is applied.

FIG. 1 shows the composition of the periphery of the image forming unit in an image forming apparatus wherein the photo conductor that has the protective surface layer related to the first embodiment of the present invention is applied.

As shown in this figure, the related image forming apparatus is configured with an electric charging apparatus 102 close to an organic photo conductor (hereinafter referred to as photo conductor) 101, an exposure apparatus 103, an image developing apparatus 104, and a transfer apparatus 105. The photo conductor 101 has a protective surface layer although the composition of the related protective surface layer will be described later. A drive mechanism (not shown in the figure) rotates the photo conductor 101 in the direction shown by the arrow in the figure.

The electric charging apparatus 102 uniformly charges the surface of the photo conductor 101. Although the figure shows the electric charging apparatus 102 that uniformly charges the surface of the photo conductor 101 using a non-contact electric charging method, the method is not limited to this and an apparatus can be applied that uses a contact electric charging method. The exposure apparatus 103 uses laser light to expose the charged surface. A latent image is formed on the surface of the photo conductor 101 by this action. The image developing apparatus 104 supplies a non-magnetic developing agent (toner) to an internal developing roller 106 and then adheres a fixed amount of toner to the latent image formed on the surface of the photo conductor 101. The transfer apparatus 105 transfers the toner adhering to the latent image to a recording paper 108 that is transported by a feed roller 107.

A cleaning apparatus 109 is arranged on the downstream side of the transfer apparatus 105 in the direction of rotation of the photo conductor 101. The cleaning apparatus 109 removes toner remaining on the surface of the photo conductor 101 after transfer to the recording paper 108. The cleaning apparatus 109 is provided with a cleaning blade 110 that makes direct contact with and removes toner remaining on the surface of the photo conductor 101.

Figure 2:
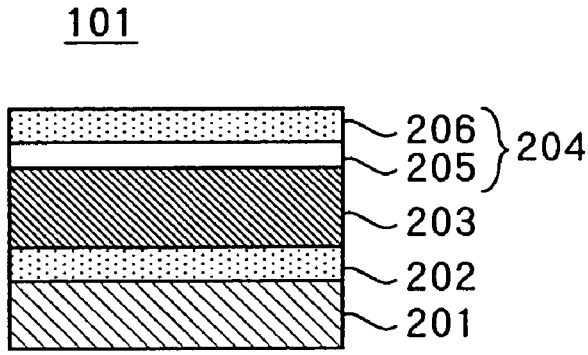
FIG. 2 is an enlarged view showing the composition of the photo conductor related to the first embodiment.

FIG. 2 is an enlarged view showing the composition of the photo conductor related to the first embodiment.

As shown in this figure, the photo conductor 101 related to the first embodiment is formed such that a carrier generation layer 202 and a carrier transport layer 203 are deposited onto a conductive base material 201 and a protective surface layer 204 is further deposited onto the layers. The protective surface layer 204 has a two layer construction of a first protective surface layer 205 and a second protective surface layer 206. These first and second protective surface layers 205 and 206 are formed in the photo conductor 101 that has the protective surface layer related to the first embodiment by a plasma CVD method.

Figure 3:
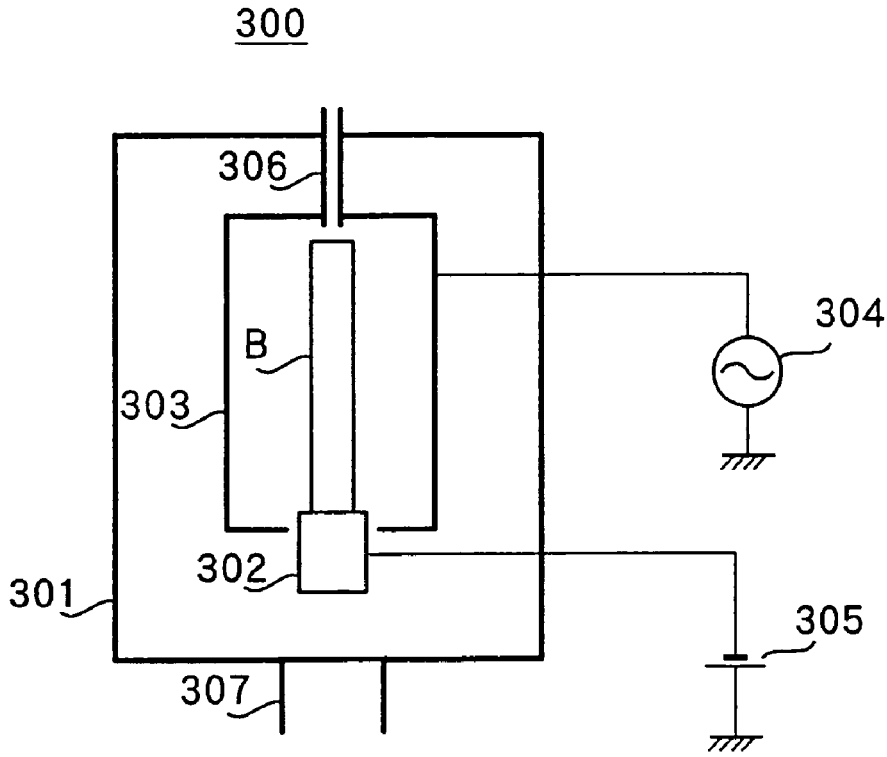
FIG. 3 is an outline of an example of a CVD deposition apparatus used when producing the photo conductor that has the protective surface layer related to the first embodiment.

FIG. 3 is an outline of an example of a CVD deposition apparatus used when producing the photo conductor 101 that has the protective surface layer related to the first embodiment. FIG. 4 shows an example of CVD gas and applied voltage utilized when forming the first protective surface layer 205 and the second protective surface layer 206 of the photo conductor 101 related to the first embodiment in the CVD deposition apparatus shown in FIG. 3.

As shown in FIG. 3, the CVD deposition apparatus 300 is provided with a substrate holder 302 that holds an item (hereinafter referred to as substrate) B on which the carrier generation layer 202 and the carrier transport layer 203 are deposited onto the conductive base material 201 and is also provided with an electrode 303 configured so as to surround the periphery of the substrate B held by the substrate holder 302. The electrode 303 has a small gap between the substrate holder 302 in the downward direction. A high-frequency power supply 304 is connected to the electrode 303 and applies a high-frequency voltage.

A DC bias power supply 305 is connected to the substrate holder 302 and applies a DC bias voltage to the substrate B through the substrate holder 302. A gas introduction port 306 is provided on the CVD deposition apparatus 300 to introduce CVD gas from the top of the inside of the electrode 303. A discharge port 307 is also provided that discharges to a vacuum container 301 any CVD gas that is introduced from the gas introduction port 306 and escapes from the gap between the substrate holder 302 and the electrode 303.

When forming a protective surface layer in this type of CVD deposition apparatus 300, the surface of the substrate B held in the substrate holder 302 is cleaned using hydrogen gas etching before forming the first protective surface layer 205. In more concrete terms, the surface of the substrate B is cleaned by introducing hydrogen gas from the gas introduction port 306 and applying a bias voltage of −500 V to −1,000 V to the substrate B. This type of cleaning operation can remove foreign matter on the surface of the substrate B and improve the adhesiveness between the carrier transport layer 203 and the first protective surface layer 205 even more. The first protective surface layer 205 and the second protective surface layer 206 are formed after the surface of the substrate B is cleaned in this manner.

As shown in FIG. 3, when forming the first protective surface layer 205 a hydrocarbon gas, such as methane, is introduced from the gas introduction port 306 as a CVD gas. A high-frequency voltage is applied to the electrode 303 when hydrocarbon gas has filled the inside of the vacuum container 301 and then a negative DC bias voltage is applied to the substrate B. Applying a high-frequency voltage changes the hydrocarbon gas inside the vacuum container 301 into plasma whereafter collisions between the electrons within the plasma and the hydrocarbon gas decompose the hydrocarbon gas and generate ions while the generated ions are attracted to the substrate B and the first protective surface layer 205 forms by applying a negative DC bias voltage to the substrate B.

As shown in FIG. 4, when forming the first protective surface layer 205, the CVD deposition apparatus 300 applies a bias voltage of −500 V to −1,000 V to the substrate B. Because of this, the ions generated by applying the high-frequency voltage are attracted to the substrate B and a portion of the ions are also injected into the carrier transport layer 203 that forms the surface of the substrate B. In other words, carbon is injected into the carrier transport layer 203 although the first protective surface layer 205 does not simply adhere to the carrier transport layer 203. The first protective surface layer 205 is formed along with a mixing layer (transition layer) on the carrier transport layer 203. At this time, the first protective surface layer 205 is formed on the surface of the substrate B by amorphous carbon accompanied by an ion implantation layer with a membrane thickness of 0.01 μm to 0.1 μm.

In contrast, as shown in FIG. 3, when forming the second protective surface layer 206, hydrocarbon gas diluted by hydrogen (hereinafter referred to as hydrogen diluted hydrocarbon gas) is introduced from the gas introduction port 306. A high-frequency voltage is applied to the electrode 303 when the hydrogen diluted hydrocarbon gas has filled the inside of the vacuum container 301 and then a negative DC bias voltage is applied to the substrate B. Applying a high-frequency voltage changes the hydrogen diluted hydrocarbon gas inside the vacuum container 301 into plasma whereafter collisions between the electrons within the plasma and the hydrogen diluted hydrocarbon gas decompose the hydrogen diluted hydrocarbon gas and generate ions while the generated ions are attracted to the substrate B and the second protective surface layer 206 forms by applying a negative DC bias voltage to the substrate B.

As shown in FIG. 4, when forming the second protective surface layer 206, the CVD deposition apparatus 300 applies a bias voltage of −100 V to −500 V, smaller than when forming the first protective surface layer 205, to the substrate B. This case is different from the first protective surface layer 205 whereby the ions generated by applying the high-frequency voltage are attracted to the substrate B but a portion of the ions are not injected the surface layer of the substrate B. The ions attracted to the substrate B deposit on the surface of the first protective surface layer 205, that forms the surface layer of the substrate B, and form the second protective surface layer 206. At this time, the second protective surface layer 206 is formed on the surface of the substrate B (the first protective surface layer 205) by an amorphous carbon deposition layer with a membrane thickness of 0.1 μm to 2.0 μm.

Furthermore, the CVD deposition apparatus 300 related to the first embodiment controls the voltage applied to the substrate B and the electrode 303 as described above and also controls the gas pressure applied to the vacuum container 301 when forming the protective surface layer 204. In more concrete terms, as shown in FIG. 4, the gas pressure when forming the second protective surface layer 206 is set high relative to the gas pressure when forming the first protective surface layer 205. In even more concrete terms, the ratio of the gas pressure when forming the first protective surface layer 205 and the gas pressure when forming the second protective surface layer 206 is set to 1~2: 2~3.

FIG. 5 shows an example of results obtained when the photo conductor that has the protective surface layer related to the first embodiment is applied to an image forming apparatus. In particular, FIG. 5 mainly shows results obtained from differences in the CVD gas used when forming the protective surface layer 204.

In addition, in particular FIG. 5 shows results obtained by comparing the adhesiveness after 1,000 prints and the resolution in a print in the initial state in an image forming unit. The figure shows a photo conductor as a target of the comparison that has a single layer protective surface layer (single layer CVD) formed by a conventional plasma CVD method.

The CVD gas introduced from the gas introduction port 306 uses methane gas as a hydrocarbon gas and a methane gas diluted by hydrogen gas (hereinafter referred to as hydrogen diluted methane gas) as a hydrogen diluted hydrocarbon gas. A methane gas diluted by argon gas (hereinafter referred to as argon diluted methane gas) is also used as a target of the comparison.

As shown in this figure, the adhesiveness between the protective surface layer and the carrier transport layer on a photo conductor that has a single layer protective surface layer was in a worsened state after 1,000 prints when methane gas, hydrogen diluted methane gas, and argon diluted methane gas were used. Because of this, scrapes on the protective surface layer due to scratches while printing and shortened lifespan of the organic photo conductor itself could occur.

In the resolution of prints in the initial state, degradation in the image resolution was avoided only when hydrogen diluted methane gas was used. When methane gas and argon diluted methane gas were used, degradation in the image resolution occurred. This is based on avoiding reductions in the electrical resistance of the protective surface layer through the use of hydrogen diluted methane gas.

In contrast, worsening of the adhesiveness between the protective surface layer and the carrier transport layer on a photo conductor that has the protective surface layer (two layer CVD) related to this embodiment after 1,000 prints was avoided when methane gas, hydrogen diluted methane gas, and argon diluted methane gas were used on the second protective surface layer 206 (second layer). This is based on carbon being injected into the carrier transport layer 203 although the first protective surface layer 205 does not simply adhere to the carrier transport layer 203. The first protective surface layer 205 is formed along with a mixing layer (transition layer on the carrier transport layer 203. Because of this, scrapes on the protective surface layer due to scratches while printing and shortened lifespan of the organic photo conductor itself can be reliably avoided.

In the resolution of prints in the initial state, degradation in the image resolution was reliably avoided when hydrogen diluted methane gas was used on the second protective surface layer 206. When methane gas was used on the second protective surface layer 206, degradation in the image resolution was avoided to a certain degree. And when argon diluted methane gas was used on the second protective surface layer 206, degradation in the image resolution occurred. This is based on avoiding reductions in the electrical resistance of the protective surface layer through the use of hydrogen diluted methane gas.

Because the first protective surface layer 205 is formed using amorphous carbon that is associated with a hydrocarbon gas ion implantation layer according to the photo conductor that has the protective surface layer related to the first embodiment, the adhesiveness between the carrier transport layer 203 and the first protective surface layer 205 can be improved. Because this makes it possible to reliably avoid scrapes on the protective surface layer due to scratches while printing and shortened lifespan of the organic photo conductor itself, the lifespan of the photo conductor can be lengthened.

Moreover, because the second protective surface layer 206 is formed using an amorphous carbon deposition layer of hydrogen diluted hydrocarbon gas according to the photo conductor that has the protective surface layer related to the first embodiment, reductions in the electrical resistance of the protective surface layer can be reliably avoided. This makes it possible to maintain the electrical resistance of the protective surface layer at a high resistance, which in turn makes it possible to reliably avoid degradation in the resolution of images due to reductions in the electrical resistance of the protective surface layer.

The composition when the photo conductor that has the protective surface layer related to the first embodiment comprises the first protective surface layer 205 formed using amorphous carbon that is associated with a hydrocarbon gas ion implantation layer and the second protective surface layer 206 formed using an amorphous carbon deposition layer of hydrogen diluted hydrocarbon gas is described. However, even if the second protective surface layer 206 is not formed using an amorphous carbon deposition layer of hydrogen diluted hydrocarbon gas, results that improve the adhesiveness between the carrier transport layer 203 and the first protective surface layer 205 can still be obtained.

FIG. 6 and FIG. 7 show examples of results obtained when the photo conductor 101 that has the protective surface layer related to the first embodiment is applied to an image forming apparatus. In particular, FIG. 6 mainly shows results obtained from differences in the gas pressure applied to the vacuum container 301 when forming the protective surface layer 204. Furthermore, FIG. 7 mainly shows results obtained from differences in DC bias voltage applied to the substrate B when forming the protective surface layer 204.

FIG. 6 and FIG. 7 further show results obtained by comparing the adhesiveness in the first protective surface layer 205 after 1,000 prints and the image resolution in the second protective surface layer 206 when printing in the initial state in an image forming unit.

As shown in FIG. 6, the adhesiveness in the first protective surface layer 205 after 1,000 prints is in a worsened state between the protective surface layer and the carrier transport layer when the ion energy is low (for example, when the gas pressure shown in FIG. 6 is 2.5 to 3). When the ion energy is high (for example, when the gas pressure shown in FIG. 6 is 1.0 to 1.5), a worsened state of the adhesiveness between the protective surface layer and the carrier transport layer is avoided. In contrast to this, degradation in the resolution in the second protective surface layer 206 when printing in the initial state occurred when the ion energy is high but when the ion energy is low, the degradation is avoided.

The related ion energy is decreased by setting the gas pressure applied to the vacuum container 301 to a high pressure and is increased by setting the gas pressure to a low pressure. Consequently, in the CVD deposition apparatus 300 related to the first embodiment, the gas pressure when forming the second protective surface layer 206 is set high relative to the gas pressure when forming the first protective surface layer 205.

Because the gas pressure when forming the first protective surface layer 205 is set low relative to the gas pressure when forming the second protective surface layer 206 according to the photo conductor that has the protective surface layer related to the first embodiment, the adhesiveness between the carrier transport layer 203 and the first protective surface layer 205 can be improved. Because of this, scrapes on the protective surface layer due to scratches while printing and shortened lifespan of the organic photo conductor itself can be reliably avoided thereby making it possible to lengthen the lifespan of the photo conductor.

At the same time, because the gas pressure when forming the second protective surface layer 206 is set high relative to the gas pressure when forming the first protective surface layer 205 according to the photo conductor that has the protective surface layer related to the first embodiment, the electrical resistance of the second protective surface layer 206 can be set higher than the first protective surface layer 205. Because of this, the image resolution in the second protective surface layer 206 can be maintained at a high quality.

In contrast, when viewing fluctuations of ion energy from the viewpoint of a DC bias voltage applied to the substrate B, the ion energy is decreased (for example, when the DC bias voltage shown in FIG. 7 is −100 V to −300 V) by setting the DC bias voltage to a smaller voltage and is increased (for example, when the DC bias voltage shown in FIG. 7 is −1,000 V) by setting the DC bias voltage to a larger voltage as shown in FIG. 7. Because of this, in the CVD deposition apparatus 300 related to the first embodiment, the DC bias voltage applied to the substrate B when forming the second protective surface layer 206 is set smaller than the DC bias voltage when forming the first protective surface layer 205.

Because the DC bias voltage applied to the substrate B when forming the first protective surface layer 205 is set larger than the DC bias voltage when forming the second protective surface layer 206 according to the photo conductor that has the protective surface layer related to the first embodiment, the adhesiveness between the carrier transport layer 203 and the first protective surface layer 205 can be improved. Because of this, even if the number of prints is increased, scrapes on the protective surface layer due to scratches while printing and shortened lifespan of the organic photo conductor itself can be reliably avoided thereby making it possible to lengthen the lifespan of the photo conductor.

At the same time, because the DC bias voltage when forming the second protective surface layer 206 is set smaller than the DC bias voltage when forming the first protective surface layer 205 according to the photo conductor that has the protective surface layer related to the first embodiment, the electrical resistance of the second protective surface layer 206 can be set higher than the first protective surface layer 205. Because of this, the image resolution in the second protective surface layer 206 can be maintained at a high quality.

Second Embodiment

Figure 8:
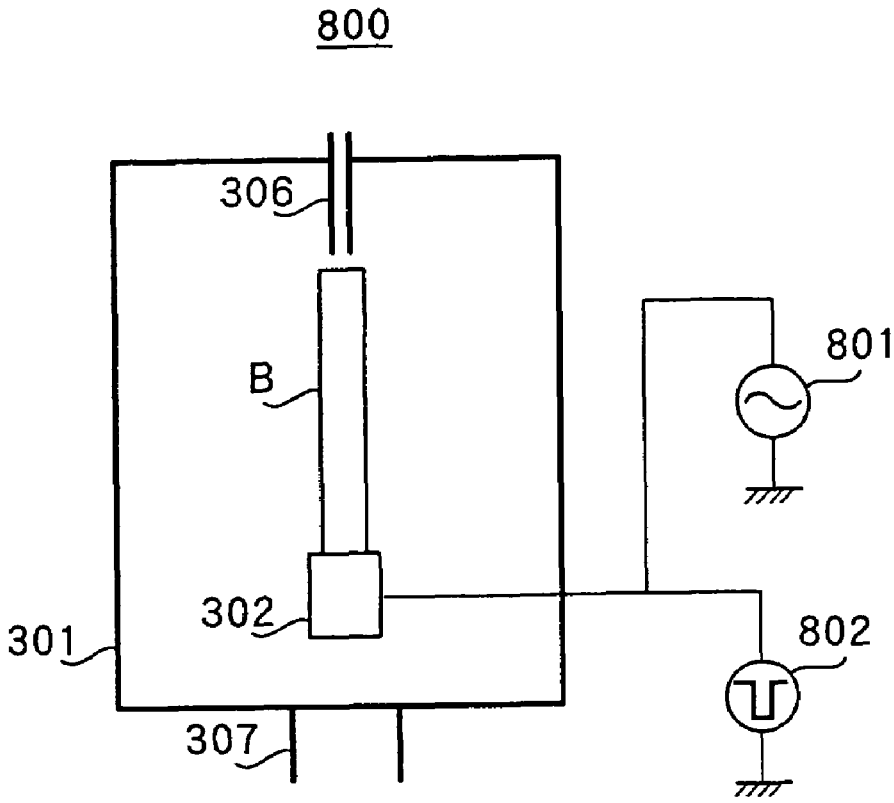
FIG. 8 is an outline of an example of a CVD deposition apparatus used when producing the photo conductor that has the protective surface layer related to the second embodiment of the present invention.

FIG. 8 is an outline of an example of a CVD deposition apparatus 800 used when producing the photo conductor 101 that has the protective surface layer related to the second embodiment of the present invention. FIG. 9 shows an example of CVD gas and applied voltage utilized when forming the first protective surface layer 205 and the second protective surface layer 206 of the photo conductor related to the second embodiment in the CVD deposition apparatus 800 shown in FIG. 8.

The CVD deposition apparatus 800 shown in FIG. 8 differs from the CVD deposition apparatus 300 shown in FIG. 3 in that the electrode 303 is not provided, a high-frequency voltage pulse power supply 801 and a bias voltage pulse power supply 802 are provided instead of the high-frequency power supply 304 and the DC bias power supply 305, respectively, and the high-frequency voltage pulse power supply 801 is connected to the substrate holder 302. Where identical numbers and symbols are used for the composition that has functions identical to the composition shown in FIG. 3, their description will be omitted.

The photo conductor 101 that has the protective surface layer related to the second embodiment is produced by the CVD deposition apparatus 800 that has the above-mentioned composition. Therefore, compared to the CVD deposition apparatus 300 related to the first embodiment, the space required for the electrode 303 can be eliminated and the substrate B placed in that space thereby making it ideal when producing large quantities of photo conductor.

Forming a protective surface layer the CVD deposition apparatus 800 related to the second embodiment is similar to the CVD deposition apparatus 300 related to the first embodiment in that the surface of the substrate B held in the substrate holder 302 is cleaned using hydrogen gas etching before forming the first protective surface layer 205.

As shown in FIG. 9, when forming first protective surface layer 205, a hydrocarbon gas, such as methane, is introduced from the gas introduction port 306 as a CVD gas. A superimposed voltage having a negative bias voltage pulse and a high-frequency voltage pulse is applied to the substrate B when hydrocarbon gas has filled the inside of the vacuum container 301. Details of this superimposed voltage will be described later. Applying a high-frequency voltage to the substrate B changes the hydrocarbon gas inside the vacuum container 301 into plasma whereafter collisions between the electrons within the plasma and the hydrocarbon gas decompose the hydrocarbon gas and generate ions while the generated ions are attracted to the substrate B and the first protective surface layer 205 forms by applying a negative bias voltage pulse to the substrate B.

As shown in FIG. 9, when forming the first protective surface layer 205, the CVD deposition apparatus 800 applies a bias voltage of −5 kV to −10 kV to the substrate B. Because of this, the ions generated by applying the high-frequency voltage are attracted to the substrate B and a portion of the ions are also injected into the carrier transport layer 203 that forms the surface of the substrate B. In other words, carbon is injected into the carrier transport layer 203 although the first protective surface layer 205 does not simply adhere to the carrier transport layer 203. The first protective surface layer 205 is formed along with a mixing layer (transition layer) on the carrier transport layer 203. At this time, the first protective surface layer 205 is formed on the surface of the substrate B by amorphous carbon accompanied by an ion implantation layer with a membrane thickness of 0.01 μm to 0.1 μm.

In contrast, as shown in FIG. 9, when forming the second protective surface layer 206, hydrogen diluted hydrocarbon gas is introduced from the gas introduction port 306. A superimposed voltage having a negative bias voltage pulse and a high-frequency voltage pulse is applied to the substrate B when the hydrogen diluted hydrocarbon gas has filled the inside of the vacuum container 301. Applying a high-frequency voltage pulse to the substrate B changes the hydrogen diluted hydrocarbon gas inside the vacuum container 301 into plasma whereafter collisions between the electrons within the plasma and the hydrogen diluted hydrocarbon gas decompose the hydrogen diluted hydrocarbon gas and generate ions while the generated ions are attracted to the substrate B and the second protective surface layer 206 forms by applying a negative bias voltage pulse to the substrate B.

As shown in FIG. 9, when forming the second protective surface layer 206, the CVD deposition apparatus 800 applies a bias voltage pulse of −500 V to −1000 V, smaller than when forming the first protective surface layer 205, to the substrate B. This case is different from the first protective surface layer 205 whereby the ions generated by applying the high-frequency voltage pulse are attracted to the substrate B but a portion of the ions are not injected the surface layer of the substrate B. The ions attracted to the substrate B deposit on the surface of the first protective surface layer 205, that forms the surface layer of the substrate B, and form the second protective surface layer 206. At this time, the second protective surface layer 206 is formed on the surface of the substrate B (the first protective surface layer 205) by an amorphous carbon deposition layer with a membrane thickness of 0.1 μm to 2.0 μm.

FIG. 10 to FIG. 13 show examples of results obtained when the photo conductor 101 that has the protective surface layer related to the second embodiment is applied to an image forming apparatus. In particular, FIG. 10 mainly shows results obtained from differences in the bias voltage pulses applied to the substrate B when forming the protective surface layer 204. FIG. 11 mainly shows results obtained from differences in the pulse width of the bias voltage (hereinafter referred to as bias pulse width) applied to the substrate B when forming the protective surface layer 204. Further, FIG. 12 mainly shows results obtained from differences in the pulse width of the high-frequency voltage (hereinafter referred to as high-frequency pulse width) applied to the substrate B when forming the protective surface layer 204. Even further, FIG. 13 mainly shows results obtained from differences in the electron temperature of the plasma that generates when forming the protective surface layer 204.

In particular, FIG. 10 to FIG. 13 show results obtained by comparing the adhesiveness in the first protective surface layer 205 after 1,000 prints and the image resolution in the second protective surface layer 206 while printing in the initial state in an image forming unit.

As shown in FIG. 10, the adhesiveness in the first protective surface layer 205 after 1,000 prints is in a worsened state between the protective surface layer and the carrier transport layer when the ion energy is low (for example, when the bias voltage shown in FIG. 10 is −0.5 kV to −1 kV). When the ion energy is high (for example, when the bias voltage shown in FIG. 10 is −5 kV to −10 kV), a worsened state of the adhesiveness between the protective surface layer and the carrier transport layer is avoided. In contrast to this, the resolution in the second protective surface layer 206 when printing in the initial state experienced degradation in the image resolution when the ion energy is high but when the ion energy is low, the degradation in the image resolution is avoided.

The ion energy is decreased by setting the bias voltage pulse applied to the substrate B to a lower voltage and is increased by setting the bias voltage pulse to a higher voltage. Because of this, the bias voltage pulse applied to the substrate B when forming the second protective surface layer 206 is set lower than the bias voltage pulse when forming the first protective surface layer 205 in the CVD deposition apparatus 800 related to the second embodiment.

Because the bias voltage pulse applied to the substrate B when forming the first protective surface layer 205 is set larger than the bias voltage pulse when forming the second protective surface layer 206 in the photo conductor that has the protective surface layer related to the second embodiment, the adhesiveness between the carrier transport layer 203 and the first protective surface layer 205 can be improved. Because of this, even if the number of prints is increased, scrapes on the protective surface layer due to scratches while printing and shortened lifespan of the organic photo conductor itself can be reliably avoided thereby making it possible to lengthen the lifespan of the photo conductor.

At the same time, because the bias voltage pulse when forming the second protective surface layer 206 is set smaller than the bias voltage pulse when forming the first protective surface layer 205 according to the photo conductor that has the protective surface layer related to the second embodiment, the electrical resistance of the second protective surface layer 206 can be set higher than the first protective surface layer 205. Because of this, the image resolution in the second protective surface layer 206 can be maintained at a high quality.

In contrast, when viewing fluctuations of ion energy from the viewpoint of a bias pulse width applied to the substrate B, the ion energy is decreased (for example, when the bias pulse width shown in FIG. 11 is 20 μs to 50 μs) by setting the bias pulse width to a larger value and is increased (for example, when the bias pulse width shown in FIG. 11 is 5 μs) by setting the bias pulse width to a smaller value as shown in FIG. 11. Because of this, in the CVD deposition apparatus 800 related to the second embodiment, the bias pulse width applied to the substrate B when forming the second protective surface layer 206 is set larger than the bias pulse width when forming the first protective surface layer 205.

Because the bias pulse width applied to the substrate B when forming the first protective surface layer 205 is set smaller than the bias pulse width when forming the second protective surface layer 206 in the photo conductor that has the protective surface layer related to the second embodiment, the adhesiveness between the carrier transport layer 203 and the first protective surface layer 205 can be improved. Because of this, even if the number of prints is increased, scrapes on the protective surface layer due to scratches while printing and shortened lifespan of the organic photo conductor itself can be reliably avoided thereby making it possible to lengthen the lifespan of the photo conductor.

At the same time, because the bias pulse width when forming the second protective surface layer 206 is set larger than the bias pulse width when forming the first protective surface layer 205 according to the photo conductor that has the protective surface layer related to the second embodiment, the electrical resistance of the second protective surface layer 206 can be set higher than the first protective surface layer 205. Because of this, the image resolution in the second protective surface layer 206 can be maintained at a high quality.

In contrast, when viewing fluctuations of ion energy from the viewpoint of a high-frequency pulse width applied to the substrate B, the ion energy is decreased (for example, when the high-frequency pulse width shown in FIG. 12 is 100 μs to 200 μs) by setting the high-frequency pulse width to a larger value and is increased (for example, when the high-frequency pulse width shown in FIG. 12 is 10 μs to 20 μs) by setting the high-frequency pulse width to a smaller value as shown in FIG. 12. Because of this, in the CVD deposition apparatus 800 related to the second embodiment, the high-frequency pulse width applied to the substrate B when forming the second protective surface layer 206 is set larger than the high-frequency pulse width when forming the first protective surface layer 205.

Because the high-frequency pulse width applied to the substrate B when forming the first protective surface layer 205 is set smaller than the high-frequency pulse width when forming the second protective surface layer 206 in the photo conductor that has the protective surface layer related to the second embodiment, the adhesiveness between the carrier transport layer 203 and the first protective surface layer 205 can be improved. Because of this, even if the number of prints is increased, scrapes on the protective surface layer due to scratches while printing and shortened lifespan of the organic photo conductor itself can be reliably avoided thereby making it possible to lengthen the lifespan of the photo conductor.

At the same time, because the high-frequency pulse width when forming the second protective surface layer 206 is set larger than the high-frequency pulse width when forming the first protective surface layer 205 according to the photo conductor that has the protective surface layer related to the second embodiment, the electrical resistance of the second protective surface layer 206 can be set higher than the first protective surface layer 205. Because of this, the image resolution in the second protective surface layer 206 can be maintained at a high quality.

Even further, as shown in FIG. 13, the adhesiveness in the first protective surface layer 205 after 1,000 prints is in a worsened state between the protective surface layer and the carrier transport layer when the electron temperature within the plasma generated when forming the protective surface layer 204 is low (for example, when the forming time shown in FIG. 13 is 15 μs to 50 μs). When the electron temperature is high (for example, when the forming time shown in FIG. 13 is 0 μs to 5 μs or 75 μs to 100 μs), a worsened state of the adhesiveness between the protective surface layer and the carrier transport layer is avoided. In contrast to this, degradation in the resolution in the second protective surface layer 206 when printing in the initial state occurred when the electron temperature is high but when the electron temperature is low, the degradation is avoided. In this specification the electron temperature is the temperature when converting the average motion energy of the electrons within the plasma to thermal energy.

The related electron temperature of the plasma varies in proportion to variations in the voltage application timing between the high-frequency voltage pulse and the bias voltage pulse superimposed and applied to the substrate. In more concrete terms, the electron temperature varies in proportion to the lengthening and shortening of the time from when the high-frequency voltage pulse is turned OFF until the bias voltage pulse is applied (hereinafter referred to as forming time). In even more concrete terms, as shown in FIG. 13 the electron temperature is increased by setting the forming time shorter (0 μs to 5 μs) or longer (75 μs to 100 μs) and is decreased by setting the forming time to a length in between these. Therefore, in the CVD deposition apparatus 800 related to the second embodiment, the forming time when forming the second protective surface layer 206 is set shorter than the forming time when forming the first protective surface layer 205. In more concrete terms, the forming time when forming the first protective surface layer 205 is set to 80 μs to 150 μs and the forming time when forming the second protective surface layer 206 is set to 10 μs to 50 μs.

Because the forming time when forming the first protective surface layer 205 is set longer than the forming time when forming the second protective surface layer 206 according to the photo conductor that has the protective surface layer related to the second embodiment, the adhesiveness between the carrier transport layer 203 and the first protective surface layer 205 can be improved. Because of this, even if the number of prints is increased, scrapes on the protective surface layer due to scratches while printing and shortened lifespan of the organic photo conductor itself can be reliably avoided thereby making it possible to lengthen the lifespan of the photo conductor.

At the same time, because the forming time when forming the first protective surface layer 205 is set longer than the forming time when forming the second protective surface layer 206 according to the photo conductor that has the protective surface layer related to the second embodiment, the electrical resistance of the second protective surface layer 206 can be set higher than the first protective surface layer 205. Because of this, the image resolution in the second protective surface layer 206 can be maintained at a high quality.

An example in which the forming time when forming the second protective surface layer 206 is set shorter than the forming time when forming the first protective surface layer 205 is cited here. Conversely, the forming time when forming the second protective surface layer 206 can also be set longer than the forming time when forming the first protective surface layer 205. For example, the forming time when forming the first protective surface layer 205 can be set to 0 μs to 5 μs and the forming time when forming the second protective surface layer 206 can also be set 10 μs to 50 μs. Results related to the second embodiment can be obtained when changing and setting the forming time in this manner.

Hereupon, FIGS. 14 to 17 are used to describe the principle of the above-mentioned electron temperature being increased by setting the forming time shorter (0 μs to 5 μs) or longer (75 μs to 100 μs) and being decreased by setting the forming time to a length in between these (15 μs to 50 μs).

Figure 14:
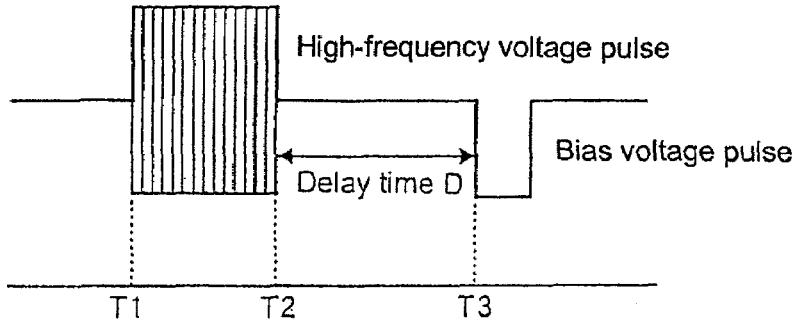
FIG. 14 shows the relationship between high-frequency voltage pulses and bias voltage pulses superimposed and applied to substrate B as well as the forming time D of these pulses in the photo conductor that has protective surface layer related to the second embodiment.
Figure 15:
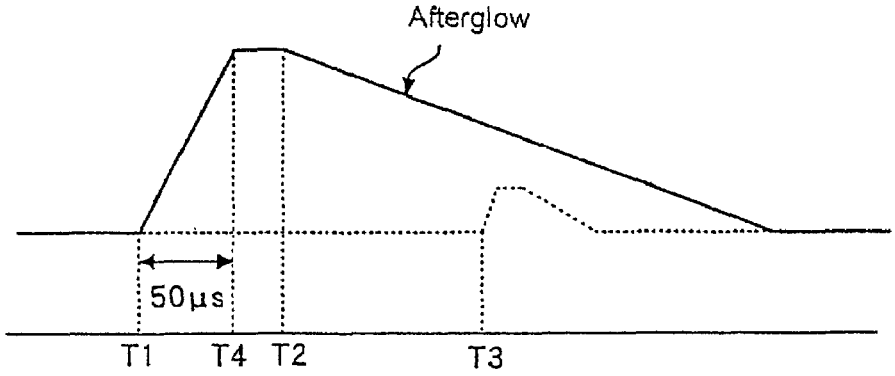
FIG. 15 shows the plasma density when the voltage pulses shown in FIG. 14 are applied to substrate B.
Figure 16:
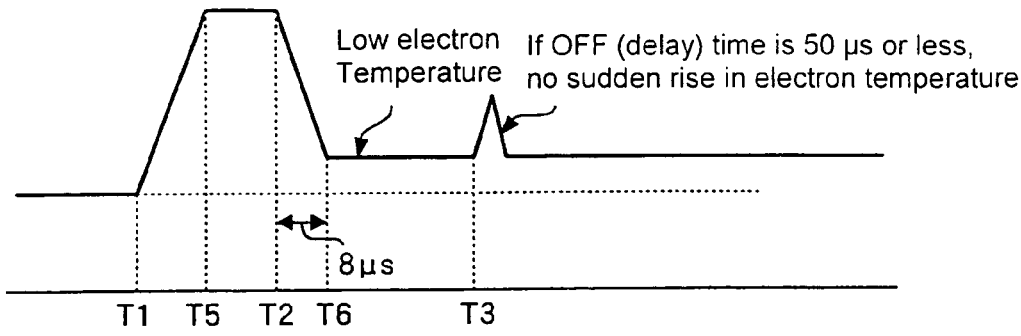
FIG. 16 shows the electron temperature of plasma when the voltage pulses shown in FIG. 14 are applied to substrate B.
Figure 17:
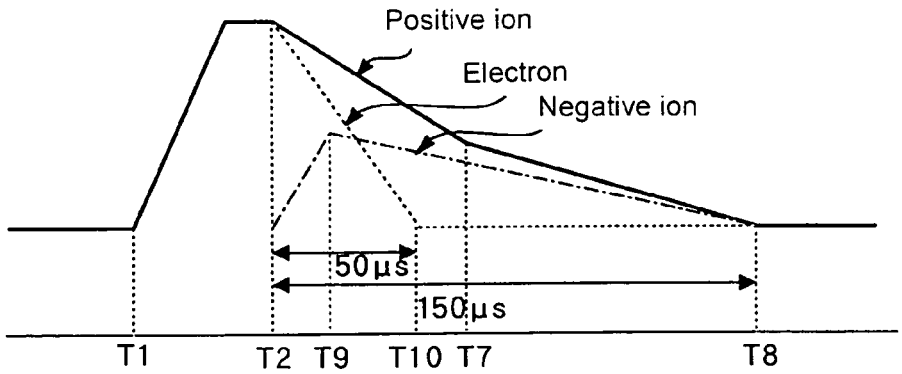
FIG. 17 uses ion and electron units to show plasma density when the voltage pulses shown in FIG. 14 are applied to substrate B.

FIG. 14 shows the relationship between high-frequency voltage pulses and bias voltage pulses superimposed and applied to substrate B as well as the forming time D of these pulses. FIG. 15 shows plasma density when the voltage pulses shown in FIG. 14 are applied to substrate B. FIG. 16 shows the electron temperature of plasma when the voltage pulses shown in FIG. 14 are applied to substrate B. FIG. 17 uses ion and electron units to show the plasma density when the voltage pulses shown in FIG. 14 are applied to substrate B.

In FIG. 14, after the high-frequency voltage pulse is applied to the substrate B from time T1, the application of this voltage stops at time T2. Then the bias voltage pulse is applied to the substrate B at time T3 after forming time D has elapsed from time T2. The voltage is repeatedly applied to the substrate B every 1 ms while the voltage pulse is being applied to the substrate B. The forming time D in this figure is, for example, set to 80 μs.

As shown in FIG. 15, when the voltage pulse shown in FIG. 14 is applied to the substrate B, the plasma density will rise from time T1. Then, saturation will occur at time T4 after 50 μs has elapsed from time T1. The saturated state is maintained while the high-frequency voltage pulse is being applied. When the application of the high-frequency voltage pulse stops at time T2 after this, the plasma density will gradually decrease and result in an afterglow characteristic. FIG. 15 shows a state in which time T3 is exceeded and the plasma density decreases due to the afterglow characteristic. When a bias voltage pulse is applied at time T3, the plasma density rises temporarily. However, because the plasma density that decreases in response to the afterglow characteristic is higher than the plasma density that increased due to the application of the bias voltage pulse in this figure, the decreasing plasma density is not affected.

Furthermore, as shown in FIG. 16, when the voltage pulse shown in FIG. 14 is applied to the substrate B, the electron temperature will increase from time T1. Then, the upper limit of the electron temperature will be reached at time T5 after a fixed time has elapsed. This upper limit of the electron temperature is maintained while the high-frequency voltage pulse is being applied. When the application of the high-frequency voltage pulse stops at time T2 after this, the electron temperature will suddenly decrease. FIG. 16 shows a state in which the electron temperature decreased to a low electron temperature at time T6 after 8 μs has elapsed from time T2. A low electron temperature is maintained until time T3 at which the bias voltage pulse is applied. Then, when the bias voltage pulse is applied at time T3, the electron temperature suddenly increases.

Here, the bias voltage pulse is applied after 80 μs (forming time D) has elapsed from when the application of the high-frequency voltage pulse was stopped. The electron temperature, however, will not suddenly increase when the forming time D is equal to or later than time T6 and a time that does not pass 50 μs from time T2 is set. This is due to the fact that electrons existing in the plasma impede increases in the electron temperature after the application of the high-frequency voltage pulse is stopped.

As described in FIG. 15, the plasma density gradually decreases in response to the afterglow characteristic from time T2. Positive ions, negative ions, and electrons included within the plasma during this afterglow decrease following the passage of time as shown in FIG. 17. In other words, when the application of the high-frequency voltage pulse is stopped, the positive ions gently decrease from time T2 towards time T7 and then decrease even more from time T7 towards time T8. When the application of the high-frequency voltage pulse is stopped, the negative ions increase from time T2 towards time T9 and then gently decrease from time T9 towards time T8. On the other hand, when the application of the high-frequency voltage pulse is stopped, the electrons suddenly decrease from time T2. Then, the electrons vanish at time T10 after 50 μs has elapsed from time T2.

In other words, during a period of 50 μs from time T2 when the application of the high-frequency voltage pulse was stopped, electrons are remaining within the plasma. Because of this, the electron temperature is impeded from suddenly increasing when the forming time D is set in this period. In contrast, electrons are remaining when the forming time D is set to a period from time T2 until time T6, after 8 μs has elapsed from time T2, but the electron temperature itself has not decreased substantially thereby resulting in a high electron temperature. Furthermore, because the electrons have already vanished when the forming time D is set to time T10 or later after 50 μs has elapsed from time T2, the electron temperature increases suddenly. Consequently, the electron temperature is a high temperature when the forming time D is set shorter (0 μs to 5 μs) or longer (75 μs to 100 μs) and is a low temperature when the forming time is set to a length in between these (15 μs to 50 μs).

As shown in FIG. 9, in the CVD deposition apparatus 800 related to the second embodiment, the CVD gas introduced from the gas introduction port 306 is similar to the CVD gas used for the CVD deposition apparatus 300 related to the first embodiment. This makes it possible to obtain results based on differences in the CVD gas described using FIG. 5 in the photo conductor that has the protective surface layer related to the second embodiment.

In like manner to the first embodiment, the photo conductor that has the protective surface layer related to the second embodiment also controls the gas pressure applied to the vacuum container 301 when forming the protective surface layer 204. This makes it possible to obtain results based on differences in the gas pressure described using FIG. 6 in the CVD deposition apparatus 800 related to the second embodiment.

Third Embodiment

Figure 18:
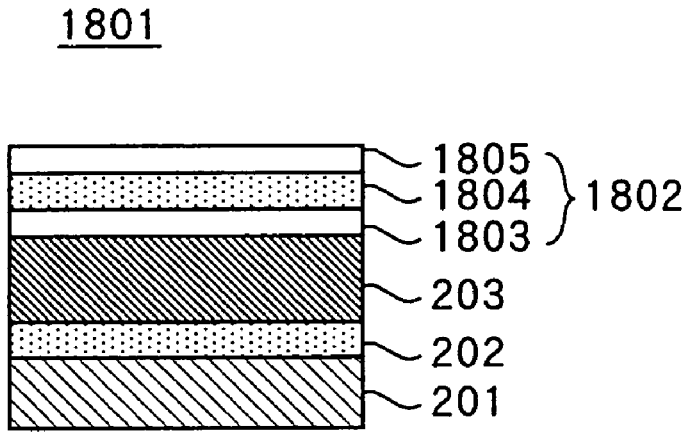
FIG. 18 is an enlarged view showing the composition of the photo conductor related to the third embodiment of the present invention.

The photo conductor that has the protective surface layer related to the third embodiment differs from the photo conductor that has the protective surface layer related to the first embodiment in that the protective surface layer 204 has a three layer construction. FIG. 18 is an enlarged view showing the composition of the photo conductor 1801 related to the third embodiment of the present invention. Where identical numbers and symbols are used for the composition that has functions identical to the composition shown in FIG. 2, their description will be omitted.

As shown in this figure, the photo conductor 1801 related to the third embodiment comprises a carrier generation layer 202 and a carrier transport layer 203 deposited onto a conductive base material 201, and a protective surface layer 1802 further deposited onto the layers. The protective surface layer 1802 has a three later construction of a first protective surface layer 1803, a second protective surface layer 1804, and a third protective surface layer 1805. Because the protective surface layer 1802 has a three later construction, superior durability and a longer lifespan of the photo conductor are possible compared to a photo conductor comprising a second protective surface layer with a two layer construction. These first, second, and third protective surface layers 1803 to 1805 are formed on the photo conductor 1801 related to the third embodiment using a plasma CVD method.

The CVD deposition apparatus 300 (FIG. 3) described in the first embodiment is used when producing the photo conductor 1801 that has the protective surface layer related to the third embodiment. When forming a protective surface layer in the CVD deposition apparatus 300 in this manner, the surface of the substrate B held in the substrate holder 302 is cleaned using hydrogen gas etching before forming the first protective surface layer 1803.

FIG. 19 shows an example of CVD gas and applied voltage utilized when forming the first protective surface layer 1803, the second protective surface layer 1804, and the third protective surface layer 1805 of the photo conductor 1801 related to the third embodiment in the CVD deposition apparatus 300.

The CVD gas utilized when forming the first protective surface layer 1803 is similar to the gas when forming the first protective surface layer 205 in the photo conductor 101 related to the first embodiment. Because of this, the first protective surface layer 1803 is formed on the surface of the substrate B by amorphous carbon accompanied by an ion implantation layer with a membrane thickness of 0.01 μm to 0.1 μm in like manner to the first protective surface layer 205 related to the first embodiment.

The CVD gas utilized when forming the second protective surface layer 1804 differs from the CVD gas utilized when forming the second protective surface layer 206 related to the first embodiment in that a negative DC bias voltage is applied to the substrate B. A bias voltage of −200 V to −500 V is applied to the substrate B when forming the second protective surface layer 1804 related to the third embodiment in contrast to a bias voltage of −100 V to −500 V being applied to the substrate B when forming the second protective surface layer 206 related to the first embodiment.

Furthermore, the relative values of the gas pressure between the first protective surface layers are also different. The gas pressure when forming the second protective surface layer 1804 related to the third embodiment is set almost identical to the gas pressure when forming the first protective surface layer 1803 in contrast to the gas pressure when forming the second protective surface layer 206 related to the first embodiment that is set higher than the gas pressure when forming the first protective surface layer 205.

On the other hand, as shown in FIG. 19, hydrogen diluted hydrocarbon gas is introduced from the gas introduction port 306 when forming the third protective surface layer 1805. A high-frequency voltage is applied to the electrode 303 when the hydrogen diluted hydrocarbon gas has filled the inside of the vacuum container 301 and then a negative DC bias voltage is applied to the substrate B. Applying a high-frequency voltage changes the hydrogen diluted hydrocarbon gas inside the vacuum container 301 into plasma whereafter collisions between the electrons within the plasma and the hydrogen diluted hydrocarbon gas decompose the hydrogen diluted hydrocarbon gas and generate ions while the generated ions are attracted to the substrate B and the third protective surface layer 1805 forms by applying a negative DC bias voltage to the substrate B.

As shown in FIG. 19, when forming the third protective surface layer 1805, the CVD deposition apparatus 300 applies a bias voltage of −0 V to −100 V, smaller than when forming the second protective surface layer 1804, to the substrate B. For this case, the ions generated by applying the high-frequency voltage are attracted to the substrate B but a portion of the ions are not injected the surface layer of the substrate B, which is different from the case of the first protective surface layer 1803. The ions attracted to the substrate B deposit on the surface of the second protective surface layer 1804, that forms the surface layer of the substrate B, and form the third protective surface layer 1805. At this time, the third protective surface layer 1805 is formed on the surface of the substrate B (the second protective surface layer 1804) by an amorphous carbon deposition layer with a membrane thickness of 0.01 μm to 0.1 μm. As described later, the electrical resistance of the third protective surface layer 1805 is set higher than the electrical resistance of the second protective surface layer 1804 by manipulating the gas pressure and ion energy. FIG. 19 shows a high resistance deposition layer resulting from this. The related third protective surface layer 1805 functions as a layer (insulation layer) that has an insulation effect in the photo conductor that has the protective surface layer related to this embodiment.

As shown in FIG. 19, in the photo conductor 1801 related to the third embodiment, the gas pressure applied to the vacuum container 301 when forming the third protective surface layer 1805 is set higher than the gas pressure when forming the first protective surface layer 1803 and the second protective surface layer 1804. In more concrete terms, the ratio of the gas pressure when forming the first protective surface layer 1803 and the gas pressure when forming the third protective surface layer 1805 is set to 1~2: 2~3.

FIGS. 20 and 21 show examples of results obtained when the photo conductor 1801 that has the protective surface layer related to the third embodiment is applied to an image forming apparatus. In particular, FIG. 20 mainly shows results obtained from differences in the gas pressure applied to the vacuum container 301 when forming the protective surface layer 1802. FIG. 21 mainly shows results obtained from differences in the DC bias voltage applied to the substrate B when forming the protective surface layer 1802.

In particular, FIGS. 20 and 21 show results of comparing the adhesiveness in the first protective surface layer 1803 and the second protective surface layer 1804 after 1,000 prints and the resolution in the third protective surface layer 1805 when printing in the initial state in an image forming unit.

As shown in FIG. 20, the adhesiveness in the first protective surface layer 1803 and the second protective surface layer 1804 after 1,000 prints is in a worsened state between the protective surface layer and the carrier transport layer when the ion energy is low (for example, when the gas pressure shown in FIG. 20 is 2.5 to 3). When the ion energy is high (for example, when the gas pressure shown in FIG. 20 is 1.0 to 1.5), a worsened state of the adhesiveness between the protective surface layer and the carrier transport layer is avoided. In contrast to this, degradation in the resolution in the third protective surface layer 1805 when printing in the initial state occurred when the ion energy is high but when the ion energy is low, the degradation is avoided.

As described in the first embodiment, the related ion energy is decreased by setting the gas pressure applied to the vacuum container 301 to a high pressure and is increased by setting the gas pressure to a low pressure. Consequently, in the CVD deposition apparatus 300 related to the third embodiment, the gas pressure when forming the third protective surface layer 1805 is set high relative to the gas pressure when forming the second protective surface layer 1804.

Because the gas pressure when forming the first protective surface layer 1803 and the second protective surface layer 1804 is set low relative to the gas pressure when forming the third protective surface layer 1805 according to the photo conductor that has the protective surface layer related to the third embodiment, the adhesiveness between the carrier transport layer 203 and the first protective surface layer 1803, as well as the adhesiveness between the first protective surface layer 1803 and the second protective surface layer 1804 can be improved. Because of this, scrapes on the protective surface layer due to scratches while printing and shortened lifespan of the organic photo conductor itself can be reliably avoided thereby making it possible to lengthen the lifespan of the photo conductor.

At the same time, because the gas pressure when forming the third protective surface layer 1805 is set high relative to the gas pressure when forming the first protective surface layer 1803 and the second protective surface layer 1804 according to the photo conductor that has the protective surface layer related to the third embodiment, the electrical resistance of the third protective surface layer 1805 can be set higher than the second protective surface layer 1804. Because of this, the image resolution in the third protective surface layer 1805 can be maintained at a high quality.

In contrast, when viewing fluctuations of ion energy from the viewpoint of a DC bias voltage applied to the substrate B, the ion energy is decreased (for example, when the DC bias voltage shown in FIG. 21 is −100 V to −300 V) by setting the DC bias voltage to a smaller voltage and is increased (for example, when the DC bias voltage shown in FIG. 21 is −1,000 V) by setting the DC bias voltage to a larger voltage as shown in FIG. 21. Because of this, in the CVD deposition apparatus 300 related to the third embodiment, the DC bias voltage applied to the substrate B when forming the third protective surface layer 1805 is set smaller than the DC bias voltage when forming the first protective surface layer 1803 and the second protective surface layer 1804.

Because the DC bias voltage applied to the substrate B when forming the first protective surface layer 1803 and the second protective surface layer 1804 is set low larger than the DC bias voltage when forming the third protective surface layer 1805 in the photo conductor that has the protective surface layer related to the third embodiment, the adhesiveness between the carrier transport layer 203 and the first protective surface layer 1803, as well as the adhesiveness between the first protective surface layer 1803 and the second protective surface layer 1804 can be improved. Because of this, even if the number of prints increases, scrapes on the protective surface layer due to scratches when printing and shortened lifespan of the organic photo conductor itself can be reliably avoided thereby making it possible to lengthen the lifespan of the photo conductor.

At the same time, because the DC bias voltage when forming the third protective surface layer 1805 is set smaller than the DC bias voltage when forming the first protective surface layer 1803 and the second protective surface layer 1804 according to the photo conductor that has the protective surface layer related to the third embodiment, the electrical resistance of the third protective surface layer 1805 can be set higher than the second protective surface layer 1804. Because of this, the image resolution in the third protective surface layer 1805 can be maintained at a high quality.

As shown in FIG. 19, the CVD deposition apparatus 300 in the third embodiment uses the same type of CVD gas as the first embodiment for the CVD gas introduced from the gas introduction port 306. This makes it possible to obtain results based on differences in the CVD gas described using FIG. 5 in the photo conductor that has the protective surface layer related to the third embodiment.

Fourth Embodiment

In contrast to the photo conductor that has the protective surface layer related to the third embodiment that is produced using the CVD deposition apparatus 300 related to the third embodiment, the photo conductor that has the protective surface layer related to the fourth embodiment differs in the fact that is it produced using the CVD deposition apparatus 800 related to the second embodiment (FIG. 8). Further, the photo conductor that has the protective surface layer related to the fourth embodiment has the three layer construction shown in FIG. 18 in like manner to the photo conductor that has the protective surface layer related to the third embodiment. Because the protective surface layer 1802 has a three layer construction, it can have excellent durability and a longer lifespan of the photo conductor compared to a photo conductor comprising a protective surface layer with a two layer construction. When forming a protective surface layer in the CVD deposition apparatus 800, the surface of the substrate B held in the substrate holder 302 is cleaned using hydrogen gas etching before forming the first protective surface layer 1803 in like manner to the third embodiment.

FIG. 22 shows an example of CVD gas and applied voltage utilized when forming the first protective surface layer 1803, the second protective surface layer 1804, and the third protective surface layer 1805 of the photo conductor 1801 related to the fourth embodiment of the present invention in the CVD deposition apparatus 800.

The CVD gas utilized when forming the first protective surface layer 1803 is identical to the gas when forming the first protective surface layer 205 in the photo conductor 101 related to the second embodiment. Because of this, the first protective surface layer 1803 is formed on the surface of the substrate B by amorphous carbon accompanied by an ion implantation layer with a membrane thickness of 0.01 μm to 0.1 μm in like manner to the first protective surface layer 205 related to the second embodiment.

The CVD gas utilized when forming the second protective surface layer 1804 differs from the gas utilized when forming the second protective surface layer 206 related to the second embodiment in that a bias voltage pulse is applied to the substrate B. A bias voltage pulse of −1,000 V to −2,000 V is applied to the substrate B when forming the second protective surface layer 1804 in contrast to a bias voltage pulse of −500 V to −1,000 V being applied to the substrate B when forming the forming the second protective surface layer 206 related to the second embodiment.

Furthermore, the relative values of the gas pressure between the first protective surface layers are also different. The gas pressure when forming the second protective surface layer 1804 related to the fourth embodiment is set almost identical to the gas pressure when forming the first protective surface layer 1803 in contrast to the gas pressure when forming the second protective surface layer 206 related to the second embodiment that is set higher than the gas pressure when forming the first protective surface layer 205.

Even further, the high-frequency pulse width, bias pulse width, and forming time when forming the second protective surface layer 1804 are also different. The high-frequency pulse width, bias pulse width, and forming time when forming the second protective surface layer 1804 related to the fourth embodiment are set to 10 μs to 20 μs, 3 μs to 10 μs, and 80 μs to 150 μs, respectively in contrast to the high-frequency pulse width, bias pulse width, and forming time when forming the second protective surface layer 206 related to the second embodiment being set to 50 μs to 200 μs, 20 μs to 50 μs, and 10 μs to 50 μs, respectively.

Conversely, as shown in FIG. 22, when forming the third protective surface layer 1805, hydrogen diluted hydrocarbon gas is introduced from the gas introduction port 306. A superimposed voltage having a negative voltage pulse and a high-frequency voltage pulse is applied to the substrate B when the hydrogen diluted hydrocarbon gas has filled the inside of the vacuum container 301. Applying a high-frequency voltage pulse to the substrate B changes the hydrogen diluted hydrocarbon gas inside the vacuum container 301 into plasma whereafter collisions between the electrons within the plasma and the hydrogen diluted hydrocarbon gas decompose the hydrogen diluted hydrocarbon gas and generate ions while the generated ions are attracted to the substrate B and the second protective surface layer 206 forms by applying a negative bias voltage pulse to the substrate B.

As shown in FIG. 22, when forming the third protective surface layer 1805, the CVD deposition apparatus 800 applies a bias voltage pulse of −100 V to −500 V, smaller than when forming the second protective surface layer 1804, to the substrate B. For this case, the ions generated by applying the high-frequency voltage pulse are attracted to the substrate B but a portion of the ions are not injected the surface layer of the substrate B, which is different from the case of the first protective surface layer 1803. The ions attracted to the substrate B deposit on the surface of the second protective surface layer 1804, that forms the surface layer of the substrate B, and form the third protective surface layer 1805. At this time, the third protective surface layer 1805 is formed on the surface of the substrate B (the first protective surface layer 205) by an amorphous carbon deposition layer with a membrane thickness of 0.01 μm to 0.1 μm. As described later, the electrical resistance of the third protective surface layer 1805 is set higher than the electrical resistance of the second protective surface layer 1804 by manipulating the gas pressure, ion energy, and electron temperature. FIG. 22 shows a high resistance deposition layer resulting from this. The related third protective surface layer 1805 functions as a layer (insulation layer) that has an insulation effect in the photo conductor that has the protective surface layer related to this embodiment.

FIG. 23 to FIG. 26 show an example of results obtained when the photo conductor that has the protective surface layer related to the fourth embodiment is applied to an image forming apparatus. In particular, FIG. 23 mainly shows results obtained from differences in the bias voltage pulse applied to substrate B when forming the protective surface layer 1802. Furthermore, FIG. 24 mainly shows results obtained from differences in bias pulse width applied to the substrate B when forming the protective surface layer 1802. Even further, FIG. 25 mainly shows results obtained from differences in the high-frequency pulse width applied to the substrate B when forming the protective surface layer 1802. Even further, FIG. 26 mainly shows results obtained from differences in the electron temperature of the plasma that occur when forming the protective surface layer 1802.

FIG. 23 to FIG. 26 show results obtained by comparing the adhesiveness in the first protective surface layer 1803 and the second protective surface layer 1804 after 1,000 prints and the image resolution in the third protective surface layer 1805 when printing in the initial state in an image forming unit.

As shown in FIG. 23, the adhesiveness in the first protective surface layer 1803 and the second protective surface layer 1804 after 1,000 prints is in a worsened state between the protective surface layer and the carrier transport layer when the ion energy is low (for example, when the bias voltage shown in FIG. 23 is −0.5 kV to −1 kV). When the ion energy is high (for example, when the bias voltage shown in FIG. 23 is −5 kV to −10 kV), a worsened state of the adhesiveness between the protective surface layer and the carrier transport layer is avoided. In contrast to this, the resolution in the third protective surface layer 1805 when printing in the initial state experienced degradation in the image resolution when the ion energy is high but when the ion energy is low, the degradation in the image resolution is avoided.

As described in FIG. 10, the ion energy is decreased by setting the bias voltage pulse applied to the substrate B to a lower voltage and is increased by setting the bias voltage pulse to a higher voltage. Because of this, the bias voltage pulse applied to the substrate B when forming the third protective surface layer 1805 is set lower than the bias voltage pulse when forming the first protective surface layer 1803 and the second protective surface layer 1804 in the CVD deposition apparatus 800 related to the fourth embodiment.

Because the bias voltage pulse applied to the substrate B when forming the first protective surface layer 1803 and the second protective surface layer 1804 is set larger than the bias voltage pulse when forming the third protective surface layer 1805 in the photo conductor that has the protective surface layer related to the fourth embodiment, the adhesiveness between the carrier transport layer 203 and the first protective surface layer 1803, as well as between the first protective surface layer 1803 and the second protective surface layer 1804 can be improved. Because of this, even if the number of prints is increased, scrapes on the protective surface layer due to scratches while printing and shortened lifespan of the organic photo conductor itself can be reliably avoided thereby making it possible to lengthen the lifespan of the photo conductor.

At the same time, because the bias voltage pulse when forming the third protective surface layer 1805 is set smaller than the bias voltage pulse when forming the first protective surface layer 1803 and the second protective surface layer 1804 according to the photo conductor that has the protective surface layer related to the fourth embodiment, the electrical resistance of the third protective surface layer 1805 can be set higher than the second protective surface layer 1804. Because of this, the image resolution in the third protective surface layer 1805 can be maintained at a high quality.

In contrast, when viewing fluctuations of ion energy from the viewpoint of a bias pulse width applied to the substrate B, the ion energy is decreased by setting the bias pulse width to a larger value (for example, when the bias pulse width shown in FIG. 24 is 20 μs to 50 μs) and is increased by setting the bias pulse width to a smaller value as shown in FIG. 24 (for example, when the bias pulse width shown in FIG. 24 is 5 μs). Because of this, in the CVD deposition apparatus 800 related to the fourth embodiment, the bias pulse width applied to the substrate B when forming the third protective surface layer 1805 is set larger than the bias pulse width when forming the first protective surface layer 1803 and the second protective surface layer 1804.

Because the bias pulse width applied to the substrate B when forming the first protective surface layer 1803 and the second protective surface layer 1804 is set smaller than the bias pulse width when forming the third protective surface layer 1805 in the photo conductor that has the protective surface layer related to the fourth embodiment, the adhesiveness between the carrier transport layer 203 and the first protective surface layer 1803 as well as the adhesiveness between the protective surface layer 1803 and the second protective surface layer 1804 can be improved. Because of this, even if the number of prints is increased, scrapes on the protective surface layer due to scratches while printing and shortened lifespan of the organic photo conductor itself can be reliably avoided thereby making it possible to lengthen the lifespan of the photo conductor.

At the same time, because the bias voltage pulse when forming the third protective surface layer 1805 is set larger than the bias voltage pulse when forming the first protective surface layer 1803 and the second protective surface layer 1804 according to the photo conductor that has the protective surface layer related to the fourth embodiment, the electrical resistance of the third protective surface layer 1805 can be set higher than the second protective surface layer 1804. Because of this, the image resolution in the third protective surface layer 1805 can be maintained at a high quality.

Furthermore, when viewing fluctuations of ion energy from the viewpoint of a high-frequency pulse width applied to the substrate B, the ion energy is decreased by setting the high-frequency pulse width to a larger value (for example, when the bias pulse width shown in FIG. 25 is 100 μs to 200 μs) and is increased by setting the bias pulse width to a smaller value as shown in FIG. 25 (for example, when the bias pulse width shown in FIG. 25 is 10 μs to 20 μs). Because of this, in the CVD deposition apparatus 800 related to the fourth embodiment, the high-frequency pulse width applied to the substrate B when forming the third protective surface layer 1805 is set larger than the high-frequency pulse width when forming the first protective surface layer 1803 and the second protective surface layer 1804.

Because the high-frequency pulse width applied to the substrate B when forming the first protective surface layer 1803 and the second protective surface layer 1804 is set smaller than the high-frequency pulse width when forming the third protective surface layer 1805 in the photo conductor that has the protective surface layer related to the fourth embodiment, the adhesiveness between the carrier transport layer 203 and the first protective surface layer 1803 as well as the adhesiveness between the protective surface layer 1803 and the second protective surface layer 1804 can be improved. Because of this, even if the number of prints is increased, scrapes on the protective surface layer due to scratches while printing and shortened lifespan of the organic photo conductor itself can be reliably avoided thereby making it possible to lengthen the lifespan of the photo conductor.

At the same time, because the high-frequency pulse when forming the third protective surface layer 1805 is set larger than the high-frequency pulse when forming the first protective surface layer 1803 and the second protective surface layer 1804 according to the photo conductor that has the protective surface layer related to the fourth embodiment, the electrical resistance of the third protective surface layer 1805 can be set higher than the second protective surface layer 1804. Because of this, the image resolution in the third protective surface layer 1805 can be maintained at a high quality.

Even further, as shown in FIG. 26, the adhesiveness in the first protective surface layer 1803 and the second protective surface layer 1804 after 1,000 prints is in a worsened state between the protective surface layer and the carrier transport layer when the electron temperature within the plasma generated when forming the protective surface layer 1802 is low (for example, when the forming time shown in FIG. 26 is 15 μs to 50 μs). When the electron temperature is high (for example, when the forming time shown in FIG. 26 is 0 μs to 5 μs or 75 μs to 100 μs), a worsened state of the adhesiveness between the protective surface layer and the carrier transport layer is avoided. In contrast to this, degradation in the resolution in the third protective surface layer 1805 when printing in the initial state occurred when the electron temperature is high but when the electron temperature is low, the degradation is avoided. Consequently, in the CVD deposition apparatus 800 related to the fourth embodiment, the forming time when forming the third protective surface layer 1805 is set shorter than the forming time when forming the first protective surface layer 1803 and the second protective surface layer 1804. In more concrete terms, the forming time when forming the first protective surface layer 1803 and the second protective surface layer 1804 is set to 80 μs to 150 μs and the forming time when forming the third protective surface layer 1805 is set to 10 μs to 50 μs as shown in FIG. 22.

Because the forming time when forming the first protective surface layer 1803 and the second protective surface layer 1804 is set longer than the forming time when forming the third protective surface layer 1805 in the photo conductor that has the protective surface layer related to the fourth embodiment, the adhesiveness between the carrier transport layer 203 and the first protective surface layer 1803 as well as the adhesiveness between the protective surface layer 1803 and the second protective surface layer 1804 can be improved. Because of this, even if the number of prints is increased, scrapes on the protective surface layer due to scratches while printing and shortened lifespan of the organic photo conductor itself can be reliably avoided thereby making it possible to lengthen the lifespan of the photo conductor.

At the same time, because the forming time when forming the third protective surface layer 1805 is set shorter than the forming time when forming the first protective surface layer 1803 and the second protective surface layer 1804 according to the photo conductor that has the protective surface layer related to the fourth embodiment, the electrical resistance of the third protective surface layer 1805 can be set higher than the second protective surface layer 1804. Because of this, the image resolution in the third protective surface layer 1805 can be maintained at a high quality.

An example is shown here in which the forming time when forming the third protective surface layer 1805 is set shorter than the forming time when forming the first protective surface layer 1803 and the second protective surface layer 1804. Contrary to this, however, the forming time when forming the third protective surface layer 1805 can also be set longer than the forming time when forming the first protective surface layer 1803 and the second protective surface layer 1804. For example, the forming time when forming the first protective surface layer 1803 and the second protective surface layer 1804 can be set to 0 μs to 50 μs and the forming time when forming the third protective surface layer 1805 set to 10 μs to 50 μs. The results related to the fourth embodiment can be obtained when changing and setting the forming time in this manner.

Fifth Embodiment

The photo conductor that has the protective surface layer related to the fifth embodiment differs from the photo conductor that has the protective surface layer related to the first embodiment in the fact that the second protective surface layer of the photo conductor produced by the CVD deposition apparatus 300 related to the first embodiment undergoes some type of processing to form an oxidation layer (insulation layer) on the surface. Because this oxidation layer (insulation layer) forms the third protective surface layer, the photo conductor that has the protective surface layer related to the fifth embodiment has a three layer construction. And because the protective surface layer 1802 is produced using a three layer construction, superior durability and a longer lifespan of the photo conductor are possible compared to a photo conductor comprising a protective surface layer with a two layer construction. The numbers and symbols shown in FIG. 18 will be used to describe the composition of the photo conductor that has a three layer construction in the following description.

In the fifth embodiment, as a first step, a method is utilized to form the third protective surface layer 1805 by a plasma CVD process that uses oxygen gas as the CVD gas as a method to oxidize the surface of the second protective surface layer 1804 of the photo conductor produced by the CVD deposition apparatus 300 and form the third protective surface layer 1805. Then, as a second step, a method is utilized to form the third protective surface layer 1805 by applying a heat treatment within air.

FIG. 27 shows an example of CVD gas and applied voltage utilized when forming the first protective surface layer 1803, the second protective surface layer 1804, and the third protective surface layer 1805 of the photo conductor 1801 related to the fifth embodiment. The first protective surface layer 1803 and the second protective surface layer 1804 in FIG. 27 are identical to the photo conductor 101 related to the first embodiment except for the gas pressure. Consequently, their description will be omitted. The third protective surface layer 1805 in FIG. 27 shows the two methods described above.

As shown in FIG. 27, when using the first method to form the third protective surface layer 1805 in the fifth embodiment, an oxygen gas is introduced from the gas introduction port 306 as a CVD gas. A high-frequency voltage is applied to the electrode 303 when oxygen gas has filled the inside of the vacuum container 301 and then a negative DC bias voltage is applied to the substrate B. Applying a high-frequency voltage changes the oxygen gas inside the vacuum container 301 into plasma whereafter collisions between the electrons within the plasma and the oxygen gas decompose the oxygen gas and generate ions while the generated ions are attracted to the substrate B and the third protective surface layer 1805 forms by applying a negative DC bias voltage to the substrate B.

As shown in FIG. 27, when forming the third protective surface layer 1805, the CVD deposition apparatus 300 applies a bias voltage of −0 V to −100 V to the substrate B. Because of this, the ions generated by applying the high-frequency voltage are attracted to the substrate B, deposit on the surface of the second protective surface layer 1804, that forms the surface layer of the substrate B, and form the third protective surface layer 1805. At this time, the third protective surface layer 1805 is formed on the surface of the substrate B (the second protective surface layer 1804) by an amorphous carbon with a membrane thickness of 0.01 μm to 0.1 μm. The related third protective surface layer 1805 functions as a layer (insulation layer) that has an insulation effect in the photo conductor that has the protective surface layer related to this embodiment.

In contrast, when using the second method to form the third protective surface layer 1805 in the fifth embodiment, the photo conductor 1801 formed up to the second protective surface layer 1804 by the CVD deposition apparatus 300 is placed into a device that can apply a heat treatment within air, such as a separately provided oven, for a fixed period of time (hereinafter, referred to as a heating device). Because of this, the third protective surface layer 1805 is formed on the surface of the substrate B (the second protective surface layer 1804) by an amorphous carbon with a membrane thickness of 0.01 μm to 0.1 μm. An appropriate time to leave the photo conductor in the heating device will be described later. The related third protective surface layer 1805 also functions as a layer (insulation layer) that has an insulation effect in the photo conductor that has the protective surface layer related to this embodiment.

The electrical resistance of the oxidized layer (insulation layer) that acts as the third protective surface layer 1805 formed in this manner is set higher than the electrical resistance possessed by the second protective surface layer 1804. Therefore, the quality of the image resolution can be improved when printing the image.

FIG. 28 shows an example of results obtained when the photo conductor 1801 that has the protective surface layer related to the fifth embodiment is applied to an image forming apparatus. In particular, FIG. 28 shows results obtained from differences in the methods when forming the third protective surface layer 1805. Furthermore, FIG. 28 shows results obtained by comparing the image resolution after 500 prints. FIG. 28 also shows an oxygen plasma process that applies the process using the first method and a heat treatment that applies the process using the second method.

As shown in this figure, when a heat treatment within air is applied to the photo conductor 1801 produced up to the second protective surface layer 1804 by the CVD deposition apparatus 300, differences in the image resolution after 500 prints appear. Compared to a photo conductor 1801 that does not has a heat treatment applied to it, improvement to the image resolution appeared to a certain degree when applying a heat treatment of 50° C. for 120 minutes or 70° C. for 30 minutes. In contrast, improvements to the quality of the image resolution clearly appeared when applying a heat treatment of 80° C. for 30 minutes, 90° C. for 30 minutes, or 100° C. for 30 minutes. In particular, when applying a heat treatment of 90° C. for 30 minutes, the quality of the resolution is noticeably improved.

Care must be taken for the exterior appearance when applying a heat treatment to the surface of the photo conductor 1801. Namely, a heat treatment for a period of time appropriate for the photo conductor 1801 will produce an effect that improves the resolution. However, a heat treatment for a period of time excessive for the photo conductor 1801 will have a bad influence on the exterior appearance of the photo conductor 1801 itself. In the example shown in FIG. 28, very small cracks occurred on the surface of the photo conductor 1801 when applying a heat treatment of 100° C. for 30 minutes.

In contrast to this, when forming the third protective surface layer 1805 using the first method (oxygen plasma process), obvious improvements appeared in the image resolution using 5 minutes of oxygen plasma processing. For this case, the processing can be completed within a short period such as 5 minutes. Furthermore, the heat treatment will not have a bad influence on the exterior appearance.

Because some type of processing is applied to the second protective surface layer 1804 to form the third protective surface layer 1805, that forms the insulation layer (oxidized layer) in the photo conductor 1801 related to the fifth embodiment, the electrical resistance of the surface of the photo conductor 1801 can be maintained at a high level and the image resolution also maintained at a high quality.

As shown in FIG. 27, the same type of CVD gas as the CVD deposition apparatus 300 related to the first embodiment is used for the CVD gas introduced from the gas introduction port 306 in the photo conductor 1801 that has the protective surface layer related to the fifth embodiment. This makes it possible to obtain results based on differences in the CVD gas described using FIG. 5 in the photo conductor 1801 related to the fifth embodiment as well.

Sixth Embodiment

The photo conductor that has the protective surface layer related to the sixth embodiment differs from the photo conductor that has the protective surface layer related to the second embodiment in the fact that the second protective surface layer of the photo conductor produced by the CVD deposition apparatus 300 related to the second embodiment undergoes some type of processing to form an oxidation layer (insulation layer) on the surface. Because this oxidation layer (insulation layer) forms the third protective surface layer, the photo conductor that has the protective surface layer related to the sixth embodiment has a three layer construction. And because the protective surface layer 1802 is produced using a three layer construction, superior durability and a longer lifespan of the photo conductor are possible compared to a photo conductor comprising a protective surface layer with a two layer construction. The numbers and symbols shown in FIG. 18 will be used to describe the composition of the photo conductor that has a three layer construction in the following description.

In like manner to the fifth embodiment, in the sixth embodiment, as a first step, a method is utilized to form the third protective surface layer 1805 by a plasma CVD process that uses oxygen gas as the CVD gas as a method to oxidize the surface of the second protective surface layer 1804 of the photo conductor produced by the CVD deposition apparatus 800 and form the third protective surface layer 1805. Then, as a second step, a method is utilized to form the third protective surface layer 1805 by applying a heat treatment within air.

FIG. 29 shows an example of CVD gas and applied voltage utilized when forming the first protective surface layer 1803, the second protective surface layer 1804, and the third protective surface layer 1805 of the photo conductor 1801 related to the sixth embodiment. The first protective surface layer 1803 and the second protective surface layer 1804 in FIG. 29 are identical to the photo conductor 101 related to the first embodiment except for the gas pressure. Consequently, their description will be omitted. The third protective surface layer 1805 in FIG. 29 shows the two methods described above.

As shown in FIG. 29, when using the first method to form the third protective surface layer 1805 in the sixth embodiment, an oxygen gas is introduced from the gas introduction port 306 as a CVD gas. A superimposed voltage having a negative bias voltage pulse and a high-frequency voltage pulse is applied to the electrode 303 when oxygen gas has filled the inside of the vacuum container 301. Applying a high-frequency voltage to the substrate B changes the oxygen gas inside the vacuum container 301 into plasma whereafter collisions between the electrons within the plasma and the oxygen gas decompose the oxygen gas and generate ions while the generated ions are attracted to the substrate B and the third protective surface layer 1805 forms by applying a negative DC bias voltage to the substrate B.

As shown in FIG. 29, when forming the third protective surface layer 1805, the CVD deposition apparatus 800 applies a bias voltage pulse of −500 V to −1,000 V to the substrate B. For this case, the ions generated by applying the high-frequency voltage pulse are attracted to the substrate B, deposit on the surface of the second protective surface layer 1804, that forms the surface layer of the substrate B, and form the third protective surface layer 1805. At this time, the third protective surface layer 1805 is formed on the surface of the substrate B (the second protective surface layer 1804) by an amorphous carbon with a membrane thickness of 0.01 μm to 0.1 μm. The related third protective surface layer 1805 functions as a layer (insulation layer) that has an insulation effect in the photo conductor that has the protective surface layer related to this embodiment.

On the other hand, using the second method to form the third protective surface layer 1805 in the sixth embodiment is similar to the fifth embodiment and the description will be omitted.

The electrical resistance of the oxidized layer (insulation layer) that acts as the third protective surface layer 1805 formed in this manner is set higher than the electrical resistance possessed by the second protective surface layer 1804. Because of this, an effect appeared that improved the quality of the image resolution when printing images. In like manner to the fifth embodiment, related effects appeared as shown in FIG. 28.

Because some type of processing is applied to the second protective surface layer 1804 to form the third protective surface layer 1805, that forms the insulation layer (oxidized layer), in the photo conductor 1801 related to the sixth embodiment, the electrical resistance of the surface of the photo conductor 1801 can be maintained at a high level and the image resolution also maintained at a high quality.

Furthermore, as shown in FIG. 29, the same type of CVD gas as the CVD deposition apparatus 300 related to the first embodiment is used for the CVD gas introduced from the gas introduction port 306 in the photo conductor 1801 that has the protective surface layer related to the sixth embodiment. This makes it possible to obtain results based on differences in the CVD gas described using FIG. 5 in the photo conductor 1801 related to the fifth embodiment as well.

In the afore-mentioned descriptions, a composition was described when directly transferring images to recording paper from the photo conductor that has the protective surface layer related to the first to the sixth embodiments. This invention is not limited to this however. The invention can also be applied to an image forming apparatus that transfers images from the photo conductor to an intermediate transfer body, such as an intermediate transfer belt, and then transfers the images from this intermediate transfer body to recording paper.

Figure 30:
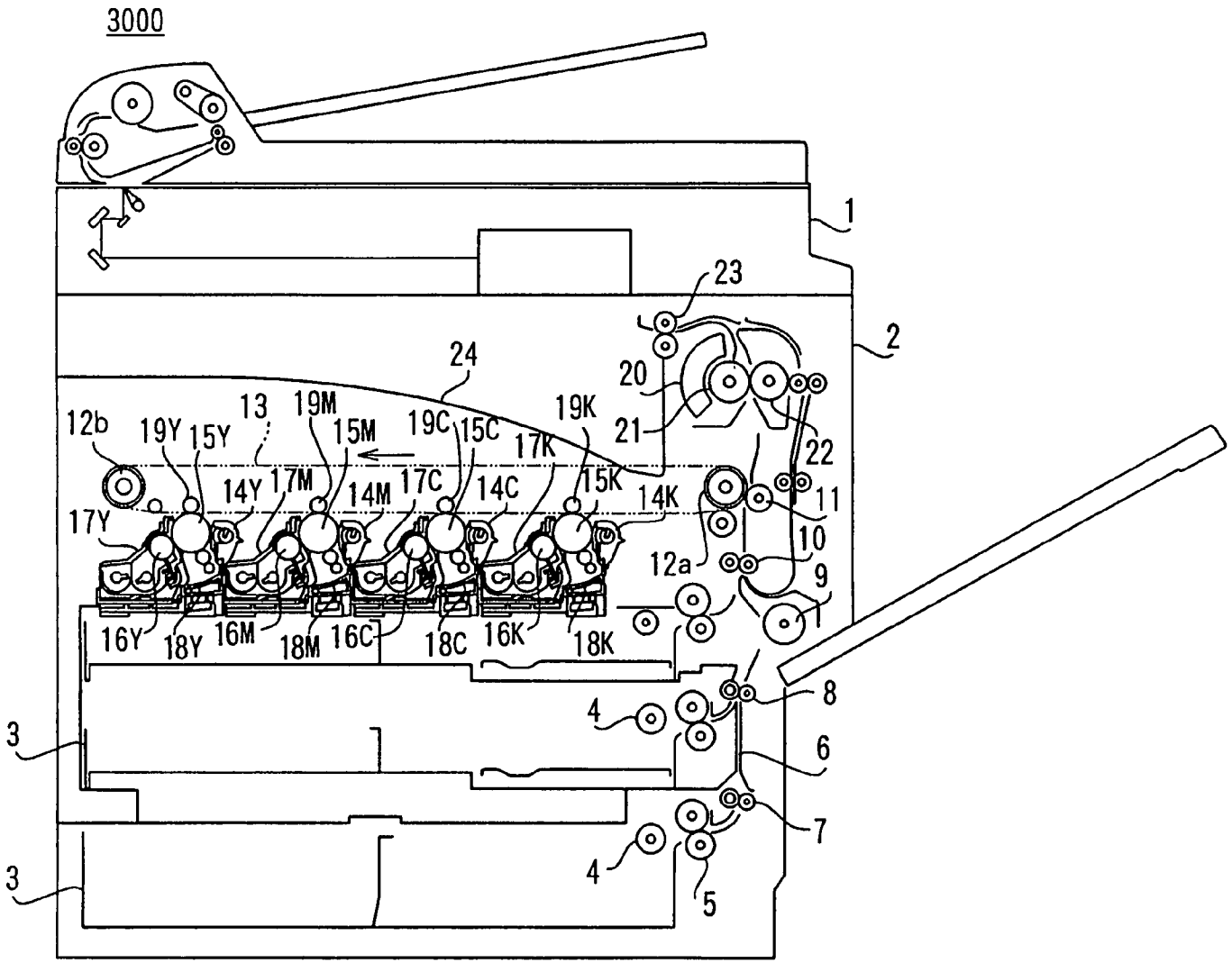
FIG. 30 is an outline compositional view showing an example of a color image forming apparatus wherein the photo conductor that has the protective surface layer related to the above-mentioned embodiments is applied.

FIG. 30 is an outline compositional view showing an example of a color image forming apparatus wherein the photo conductor that has the protective surface layer related to the above-mentioned embodiments of the present invention is applied.

In this figure, this color image forming apparatus is provided with an reading unit 1 on the upper portion that reads original documents and a main body unit 2 on the lower portion that executes paper feed, transfer, record, and fix processes.

A paper feed cassette 3 that forms multiple levels is arranged at the lower region of the main body unit 2. Recording paper positioned at the highest position is extracted from a recording paper ream, set in the paper feed cassette 3, by a pick-up roller 4. The recording paper extracted from the paper feed cassette 3 is sent from the bottom of the main body unit 2 by a paper feed roller 5 and fed into a paper path 6 formed upwards. Multiple feeding rollers 7 and 8 are arranged in the paper path 6 to further feed recording paper upwards.

The recording paper fed by the feeding roller 8 is fed by a feeding roller 9 and then transferred to a registration roller 10. A secondary transfer roller 11 is arranged at the feed destination of the recording paper using the registration roller 10. The secondary transfer roller 11 is arranged opposite a belt feed roller 12*a* from among belt feed rollers 12*a*, 12*b* that wind the afore-mentioned intermediate transfer belt. The secondary transfer roller 11 transfers color images formed on the intermediate transfer belt to the fed recording paper. Positioning adjustments between the images on the intermediate transfer belt and the recording region of the recording paper are controlled by the registration roller 10.

The belt feed roller 12*a* is arranged close to the right edge shown in FIG. 30 of the color image forming apparatus 3000 and the belt feed roller 12*b* is arranged close to the left side shown in FIG. 30. The intermediate transfer belt 13 is wound on these belt feed roller 12*a* and 12*b*. The belt feed roller 12*a* is driven by a drive roller and the intermediate transfer belt 13 rotates in the direction of the arrow shown in the figure in response to that drive.

Process cartridges 14Y to K are arranged in parallel on the surface of the intermediate transfer belt 13. These cartridges form the various colors, yellow (Y), magenta (M), cyan (C), and black (K) of an image on the surface of the intermediate transfer belt 13. Each process cartridge 14 is provided with a photo conductor drum 15Y to K that includes the photo conductor having the protective surface layer related to this embodiment. Each photo conductor drum 15 holds an image transferred to the intermediate transfer belt 13. Each process cartridge 14 is arranged opposite to each photo conductor drum 15 and are housed in housing units 18Y to K including the outer wall of developing assemblies 17Y to K, which have developing rollers 16Y to K which make images visible by adhering toner to latent images formed on each photo conductor drum 15, and the inner wall of the boxed shape main body unit 2.

Primary transfer rollers 19Y to K are provided at positions opposite to each photo conductor drum 15 on the inside of the intermediate transfer belt 13. Each primary transfer roller 19 transfers images formed on each photo conductor drum 15 to the intermediate transfer belt 13. Color images are formed on the intermediate transfer belt 13 by the primary transfer rollers 19Y to K transferring an image of each color on top of one another at the same position. Color images on this intermediate transfer belt 13 are transferred to recording paper by the secondary transfer roller 11.

A fixing unit 20 is arranged at the feed destination of the recording paper where the color image is transferred. The fixing unit 20 is provided with a fixing roller 21, and a pressurization roller 22 arranged opposite to the fixing roller 21. Images are fixed to the recording paper by the fixing roller 21 applying heat to the surface of the recording paper and the pressurization roller 22 pressing the recording paper between the fixing roller 21. Recording paper discharged from the fixing unit 20 is discharged onto a delivery tray 24 by a discharge roller 23. The delivery tray 24 is formed in the interior region of the main body unit 2 in this color image forming apparatus 3000.

Results similar to directly transferring an image from the photo conductor to the recording paper can be obtained when applied to the color image forming apparatus 3000 that transfers images to recording paper through an intermediate transfer body in this manner. In other words, even if the number of prints is increased, scrapes on the protective surface layer due to scratches while printing and shortened lifespan of the organic photo conductor itself can be reliably avoided thereby making it possible to lengthen the lifespan of the photo conductor in addition to reliably avoiding degradation in image resolution due to drops in the electrical resistance of the protective surface layer.

It is noted that the foregoing examples have been provided merely for the purpose of explanation and are in no way to be construed as limiting of the present invention. While the present invention has been described with reference to exemplary embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular structures, materials and embodiments, the present invention is not intended to be limited to the particulars disclosed herein; rather, the present invention extends to all functionally equivalent structures, methods and uses, such as are within the scope of the appended claims.

The present invention is not limited to the above described embodiments, and various variations and modifications may be possible without departing from the scope of the present invention. The above described embodiments are explained using a cylindrical photo conductor, but the present invention is not limited to these embodiments. The present invention comprises e.g. a belt-type of photo conductor.

This application is based on the Japanese Patent Application Nos. 2004-1695 filed on Jan. 7, 2004, and 2004-096923 filed on Mar. 29, 2004, entire content of which is expressly incorporated by reference herein.

What is claimed is:

1. A photo conductor comprising:

a conductive base;

a carrier generation layer provided on the conductive base and configured to generate a carrier;

a carrier transport layer provided on the carrier generation layer which is provided on the conductive base; and a protective surface layer provided on the carrier transport layer, the generated carrier being transported to the protective surface layer via the carrier transport layer, the protective surface layer comprising:

a first protective surface layer, the first protective surface layer being provided on the carrier transport layer and comprising hydrocarbon gas-based amorphous carbon with implanted ions; and a second protective surface layer, the second protective surface layer being provided on the first protective surface layer and comprising hydrocarbon gas-based amorphous carbon without implanted ions.

2. The photo conductor according to claim 1, wherein the hydrocarbon gas of the second protective surface layer is diluted with hydrogen.

3. The photo conductor according to claim 1, wherein the protective surface layer further comprises a third protective surface layer, the third protective surface layer being provided on the second protective surface layer and comprising hydrocarbon gas-based amorphous carbon, the third protective surface layer comprising an insulation layer.

4. The photo conductor according to claim 3, wherein an electrical resistance of the third protective surface layer is higher than an electrical resistance of the second protective surface layer.

5. The photo conductor according to claim 3, wherein the hydrocarbon gas of the second protective surface layer is diluted with hydrogen.

6. The photo conductor according to claim 3, wherein the insulation layer of the third protective surface layer comprises an oxidized surface of the second protective surface layer.

7. The photo conductor according to claim 3, wherein the insulation layer comprises an oxidized surface of the second protective surface layer, the oxidized surface of the second protective surface layer being oxidized by heating the surface of the second protective surface layer for a predetermined time.

8. The photo conductor according to claim 3, wherein the insulation layer comprises an oxidized surface of the second protective surface layer, the oxidized surface of the second protective surface layer being oxidized by a chemical vapor deposition, oxidation gas being utilized as chemical vapor deposition gas for the chemical vapor deposition.

9. An image forming apparatus comprising:

a charger configured to charge carriers on a photo conductor;

a laser unit configured to generate undeveloped image data on the photo conductor;

a developer configured to develop the undeveloped image data on the photo conductor; and a transfer unit configured to transfer the developed image data to a recording medium, wherein the photo conductor comprising:

a conductive base;

a carrier generation layer provided on the conductive base and configured to generate a carrier;

a carrier transport layer provided on the carrier generation layer; and a protective surface layer provided on the carrier transport layer, the generated carrier being transported to the protective surface layer via the carrier transport layer, the protective surface layer comprising:

a first protective surface layer, the first protective surface layer being provided on the carrier transport layer and comprising hydrocarbon gas-based amorphous carbon with implanted ions; and a second protective surface layer, the second protective surface layer being provided on the first protective surface layer and comprising hydrocarbon gas-based amorphous carbon without implanted ions.

10. The image forming apparatus according to claim 9, wherein the hydrocarbon gas of the second protective surface layer is diluted with hydrogen.

11. The image forming apparatus according to claim 9, wherein the surface of the photo conductor is charged by contact electric charging.

12. The image forming apparatus according to claim 9, wherein the surface of the photo conductor is charged by non-contact electric charging.

13. The image forming apparatus according to claim 9, wherein the protective surface layer further comprises a third protective surface layer, the third protective surface layer being provided on the second protective surface layer and comprising hydrocarbon gas-based amorphous carbon, the third protective surface layer comprising an insulation layer.

14. The image forming apparatus according to claim 13, wherein the hydrocarbon gas of the second protective surface layer is diluted with hydrogen.

15. The image forming apparatus according to claim 13, wherein the surface of the photo conductor is charged by a contact electric charging.

16. The image forming apparatus according to claim 13, wherein the surface of the photo conductor is charged by a non-contact electric charging.

17. A method for producing a photo conductor comprising:

depositing a carrier generation layer on a conductive base, the carrier generation layer generating a carrier;

depositing a carrier transport layer on the carrier generation layer; and depositing a protective surface layer on the carrier transport layer, the generated carrier being transported to the protective surface layer via the carrier transport layer, wherein depositing of the protective surface layer comprises:

forming a first protective surface layer on the carrier transport layer, the first protective surface layer comprising amorphous carbon with implanted ions, the amorphous carbon being formed from hydrocarbon gas, ions being generated when the amorphous carbon is formed from the hydrocarbon gas, the ions being implanted into the carrier transportation layer; and forming a second protective surface layer on the first protective surface layer, the second protective layer comprising amorphous carbon without implanted ions, the amorphous carbon being formed from the hydrocarbon gas, the ions being generated when the amorphous carbon is formed from the hydrocarbon gas, the ions not being implanted into the second protective surface layer.

18. The method according to claim 17, wherein, when the second protective surface layer is formed on the first protective surface layer, the hydrocarbon gas is diluted with hydrogen.

19. The method according to claim 17, further comprising applying a negative DC bias voltage to the conductive base layer when the protective surface layer is provided on the carrier transport layer.

20. The method according to claim 19, further comprising forming the second protective surface layer with a smaller plasma ion energy than a plasma ion energy utilized when the first protective surface layer is formed, and adjusting the plasma ion energy by controlling the negative DC bias voltage applied to the conductive base when the second protective surface layer is formed.

21. The method according to claim 19, further comprising forming the second protective surface layer with a smaller plasma ion energy than a plasma ion energy utilized when the first protective surface layer is formed, and adjusting the plasma ion energy by controlling the negative DC bias voltage applied to the conductive base when the second protective surface layer is formed to be smaller than the negative DC bias voltage applied when the first protective surface layer is formed.

22. The method according to claim 19, further comprising forming the second protective surface layer with a smaller plasma ion energy than a plasma ion energy utilized when the first protective surface layer is formed, and adjusting the plasma ion energy by controlling a pulse width of the negative DC bias voltage applied to the conductive base when the second protective surface layer is formed.

23. The method according to claim 19, further comprising forming the second protective surface layer with a smaller plasma ion energy than a plasma ion energy utilized when the first protective surface layer is formed, and adjusting the plasma ion energy by controlling a pulse width of the negative DC bias voltage applied to the conductive base when the second protective surface layer is formed to be larger than the pulse width of the negative DC bias voltage applied when the first protective surface layer is formed.

24. The method according to claim 17, further comprising applying a first negative DC bias voltage to the conductive base when the first protective surface layer is provided on the carrier transport layer, and applying a second negative DC bias voltage to the conductive base when the second protective surface layer is provided on the first protective surface layer, wherein the second negative DC bias voltage is smaller than the first negative DC bias voltage.

25. The method according to claim 17, further comprising applying a voltage to the conductive base when the protective surface layer is provided on the carrier transport layer, wherein the voltage is generated by combining a negative bias voltage pulse with a high-frequency voltage pulse.

26. The method according to claim 17, further comprising applying a first voltage to the conductive base when the first protective surface layer is provided on the carrier transport layer, and applying a second voltage to the conductive base when the second protective surface layer is provided on the first protective surface layer, wherein the first voltage is generated by combining a first negative bias voltage pulse with a high-frequency voltage pulse, and the second voltage is generated by combining a second negative bias voltage pulse with a high-frequency voltage pulse, the second negative bias voltage pulse being smaller than the first negative bias voltage pulse.

27. The method according to claim 26, further comprising forming the second protective surface layer with a smaller plasma ion energy than a plasma ion energy utilized when the first protective surface layer is formed, and adjusting the plasma ion energy by controlling a pulse width of the high-frequency voltage pulse applied to the conductive base when the second protective surface layer is formed.

28. The method according to claim 26, further comprising forming the second protective surface layer with a smaller plasma ion energy than a plasma ion energy utilized when the first protective surface layer is formed, and adjusting the plasma ion energy by controlling a pulse width of the high-frequency voltage pulse applied to the conductive base when the second protective surface layer is formed to be larger than the pulse width of the high-frequency voltage pulse applied when the first protective surface layer is formed.

29. The method according to claim 17, further comprising forming the second protective surface layer with a smaller plasma ion energy than a plasma ion energy utilized when the first protective surface layer is formed.

30. The method according to claim 29, further comprising adjusting the plasma ion energy by controlling a gas pressure of the hydrocarbon gas utilized when the second protective surface layer is formed.

31. The method according to claim 29, further comprising adjusting the plasma ion energy by controlling a gas pressure of the hydrocarbon gas utilized when the second protective surface layer is formed to be smaller than a gas pressure of the hydrocarbon gas utilized when the first protective surface layer is formed.

32. The method according to claim 17, further comprising forming the second protective surface layer with a lower plasma electron temperature than a plasma electron temperature utilized when the first protective surface layer is formed.

33. The method according to claim 17, further comprising applying voltage to the conductive base when the protective surface layer is provided on the carrier transport layer, wherein the voltage is generated by combining a bias voltage pulse with a high-frequency voltage pulse, forming the second protective surface layer with a lower plasma electron temperature than a plasma electron temperature utilized when the first protective surface layer is formed, and adjusting the plasma electron temperature by controlling a timing of an application of the bias voltage pulse and the high-frequency voltage pulse.

34. The method according to claim 33, further comprising adjusting the plasma electron temperature by controlling a time between the high-frequency voltage pulse being turned OFF and the application of the bias voltage pulse.

35. The method according to claim 34, further comprising adjusting the plasma electron temperature by controlling a forming time interval of the second protective surface layer to be shorter than a forming time of the first protective surface layer.

36. The method according to claim 34, wherein the plasma electron temperature is adjusted by controlling a forming time of the second protective surface layer to be longer than a forming time of the first protective surface layer.

37. The method according to claim 17, further comprising cleaning a surface of the carrier transport layer by etching with hydrogen gas before the first protective surface layer is formed on the carrier transport layer.

38. A photo conductor made according to the process of claim 17.

39. The method according to claim 17, wherein depositing the protective surface layer further comprises forming a third protective surface layer on the second protective surface layer by amorphous carbon as an insulation layer.

40. The method according to claim 39, wherein an electrical resistance of the third protective surface layer is higher than an electrical resistance of the second protective surface layer.

41. The method according to claim 39, wherein when the third protective surface layer is formed on the second protective surface layer, the hydrocarbon gas is diluted with hydrogen.

42. The method according to claim 39, wherein the insulation layer comprises an oxidized surface of the second protective surface layer.

43. The method according to claim 39, wherein the insulation layer comprises an oxidized surface of the second protective surface layer, the oxidized surface of the second protective surface layer being oxidized by heating the surface of the second protective surface layer for a predetermined time.

44. The method according to claim 39, wherein the insulation layer comprises an oxidized surface of the second protective surface layer, the oxidized surface of the second protective surface layer being oxidized by a chemical vapor deposition, oxidation gas being utilized as chemical vapor deposition gas for the chemical vapor deposition.

45. The method according to claim 39, further comprising forming the third protective surface layer with a smaller plasma ion energy than a plasma ion energy utilized when the second protective surface layer is formed.

46. The method according to claim 45, further comprising adjusting the plasma ion energy by controlling a gas pressure of the hydrocarbon gas utilized when the third protective surface layer is formed.

47. The method according to claim 45, further comprising adjusting the plasma ion energy by controlling a gas pressure of the hydrocarbon gas utilized when the third protective surface layer is formed to be higher than the gas pressure of the hydrocarbon gas utilized when the second protective surface layer is formed.

48. The method according to claim 39, further comprising forming the third protective surface layer with a smaller plasma ion energy than a plasma ion energy utilized when the second protective surface layer is formed, and adjusting the plasma ion energy by controlling a bias voltage applied to the conductive base when the third protective surface layer is formed.

49. The method according to claim 39, further comprising forming the third protective surface layer with a smaller plasma ion energy than a plasma ion energy utilized when the second protective surface layer is formed, and adjusting the plasma ion energy by controlling a bias voltage applied to the conductive base when the third protective surface layer is formed to be smaller than a bias voltage applied when the second protective surface layer is formed.

50. The method according to claim 39, further comprising forming the third protective surface layer with a smaller plasma ion energy than a plasma ion energy utilized when the second protective surface layer is formed, and adjusting the plasma ion energy by controlling a pulse width of a bias voltage applied to the conductive base when the second protective surface layer is formed.

51. The method according to claim 39, further comprising forming the third protective surface layer with a smaller plasma ion energy than a plasma ion energy utilized when the second protective surface layer is formed, and adjusting the plasma ion energy by controlling a pulse width of a bias voltage applied to the conductive base when the third protective surface layer is formed to be larger than the pulse width of the bias voltage applied when the second protective surface layer is formed.

52. The method according to claim 39, further comprising forming the third protective surface layer with a smaller plasma ion energy than a plasma ion energy utilized when the second protective surface layer is formed, and adjusting the plasma ion energy by controlling a pulse width of a high-frequency voltage pulse applied to the conductive base when the third protective surface layer is formed.

53. The method according to claim 39, further comprising forming the third protective surface layer with a smaller plasma ion energy than a plasma ion energy utilized when the second protective surface layer is formed, and adjusting the plasma ion energy by controlling a pulse width of a high-frequency voltage pulse applied to the conductive base when the third protective surface layer is formed to be larger than the pulse width of the high-frequency voltage pulse applied when the second protective surface layer is formed.

54. The method according to claim 39, further comprising forming the third protective surface layer with a lower plasma electron temperature than a plasma electron temperature utilized when the second protective surface layer is formed.

55. The method according to claim 39, further comprising applying voltage to the conductive base when the third protective surface layer is provided on the second protective surface layer, wherein the voltage is generated by combining a bias voltage pulse with a high-frequency voltage pulse, the third protective surface layer being formed with a lower plasma electron temperature than a plasma electron temperature utilized when the second protective surface layer is formed, and the plasma electron temperature is adjusted by controlling timing of an application of the bias voltage pulse and the high-frequency voltage pulse.

56. The method according to claim 55, further comprising adjusting the plasma electron temperature by controlling a time between the high-frequency voltage pulse being turned OFF and the application of the bias voltage pulse.

57. The method according to claim 56, further comprising adjusting the plasma electron temperature by controlling a forming time of the third protective surface layer to be shorter than a forming time of the second protective surface layer.

58. The method according to claim 56, further comprising adjusting the plasma electron temperature by controlling a forming time of the third protective surface layer to be longer than a forming time of the second protective surface layer is formed.

59. The method according to claim 39, further comprising cleaning a surface of the carrier transport layer by etching with hydrogen gas before the first protective surface layer is formed on the carrier transport layer.

60. A photo conductor made according to the process of claim 39.

* * * * *